US008302735B2

(12) United States Patent
Anasis et al.

(10) Patent No.: US 8,302,735 B2
(45) Date of Patent: Nov. 6, 2012

(54) SELF-ERECTING SUSPENSION PLATFORM SYSTEM

(75) Inventors: George Anasis, Lewis Center, OH (US); Robert E. Eddy, Johnstown, OH (US); Jean-Francois Desmedt, Herbais (BE); Brian J. Andrews, Acworth, GA (US); Ryan Crisp, Lewis Center, OH (US)

(73) Assignee: Sky Climber, LLC, Delaware, OH (US)

( * ) Notice: Subject to any disclaimer, the term of this patent is extended or adjusted under 35 U.S.C. 154(b) by 520 days.

(21) Appl. No.: 12/581,246

(22) Filed: Oct. 19, 2009

(65) Prior Publication Data

US 2010/0032237 A1 Feb. 11, 2010

Related U.S. Application Data

(63) Continuation-in-part of application No. 11/170,684, filed on Jun. 29, 2005, now abandoned.

(51) Int. Cl.
*E04G 3/28* (2006.01)

(52) U.S. Cl. ..... 182/141; 182/145

(58) Field of Classification Search ..... 182/141, 182/145, 146

See application file for complete search history.

(56) References Cited

U.S. PATENT DOCUMENTS

| | | | | |
|---|---|---|---|---|
| 533,404 | A | 1/1895 | Youngson | |
| 1,432,040 | A * | 10/1922 | Schuler | 182/145 |
| 1,667,440 | A | 4/1928 | Scannell | |
| 2,057,328 | A | 10/1936 | Cordova | |
| 2,420,903 | A | 5/1947 | Noble | |
| 2,695,818 | A | 11/1954 | Rives | |
| 3,323,616 | A | 6/1967 | Best | |
| 3,438,460 | A | 4/1969 | Solari | |
| 3,612,219 | A | 10/1971 | Fortner | |

(Continued)

FOREIGN PATENT DOCUMENTS

WO WO-2006016016 A1 2/2006

OTHER PUBLICATIONS

International Search Report and Written Opinion of the International Searching Authority for International Application No. PCT/US10/52720, mailed Dec. 2, 2010, 9 pages.

(Continued)

*Primary Examiner* — Alvin Chin Shue
(74) *Attorney, Agent, or Firm* — David J. Dawsey; Michael J. Gallagher; Gallagher & Dawsey Co., LPA

(57) ABSTRACT

A self-erecting suspension platform system having a work platform suspended between a sinistral modular mast and a dextral modular mast by a hoisting system. The modular masts are composed of at least two mast units stacked vertically and attached to one another. Each mast unit has a multifunction rail including a plurality of safety engagement devices and a stabilizer guide device, and a unit interconnection device. The work platform has at least two mast stabilizers that cooperate with the stabilizer guide devices to prevent undesired swaying of the suspended work platform. The work platform has a plurality of platform mast engagers cooperating with at least one of the mast safety engagement devices to releasably lock the platform to the modular masts. The hoisting system includes multiple carriages, hoists, and mast cables. Each carriage engages the associated mast so that the carriage may be conveniently slid up and down the mast.

13 Claims, 25 Drawing Sheets

U.S. PATENT DOCUMENTS

| | | | | |
|---|---|---|---|---|
| 3,837,428 | A | 9/1974 | Gish | |
| 4,068,737 | A | 1/1978 | Lenz | |
| 4,119,176 | A | 10/1978 | Verdu | |
| 4,294,332 | A | 10/1981 | Ready | |
| 4,619,549 | A | 10/1986 | Gilbreth | |
| 4,856,615 | A | 8/1989 | Nusbaum | |
| 4,967,876 | A | 11/1990 | Richardson et al. | |
| D318,130 | S | 7/1991 | Abbestam et al. | |
| 5,159,993 | A | 11/1992 | St-Germain | |
| 5,196,998 | A | 3/1993 | Fulton | |
| 5,579,866 | A | 12/1996 | Rowell | |
| 5,836,365 | A | 11/1998 | Derecktor | |
| 5,909,783 | A * | 6/1999 | Berish | 182/146 |
| 6,217,259 | B1 | 4/2001 | Godbersen | |
| 6,695,097 | B1 * | 2/2004 | Wiklund | 182/141 |
| 7,044,269 | B2 * | 5/2006 | Azran | 182/141 |
| 7,140,467 | B2 * | 11/2006 | Cook | 182/143 |
| 2007/0000724 | A1 | 1/2007 | Anasis et al. | |

OTHER PUBLICATIONS

International Search Report and Written Opinion of the International Searching Authority for International Application No. PCT/US06/18936, mailed Oct. 4, 2007, 6 pages.

* cited by examiner

SELF-ERECTING SUSPENSION PLATFORM SYSTEM

CROSS-REFERENCE TO RELATED APPLICATIONS

This application is a continuation-in-part of U.S. patent application Ser. No. 11/170,684, filed Jun. 29, 2005, now abandoned the content of which is hereby incorporated by reference as if completely written herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

TECHNICAL FIELD

The instant invention relates to self-erecting suspension platform systems, particularly a ground based tower supported suspension type work platform.

BACKGROUND OF THE INVENTION

Suspension type work platforms are well-known in the art. They are traditionally mounted from the roof or upper stories of a building by means of temporary roof beams or permanent mounting davits, and often employ a track-based roof carriage, or monorails, to provide movable anchoring points for a work platform system. Obviously, a roof-mounted suspension platform system requires a usable roof, and therefore such a design is inherently unusable for a vertical structure under construction, for structures having a roof covered in large part with mechanical equipment for the HVAC system, or for a sloping roof. Alternatively, work platforms may be raised from the ground by means of a lift, such as seen in various "cherry-picker" type work baskets; or with a scissors-like arrangements as seen in U.S. Pat. No. 4,114,854; or by means of an extending tower, as seen in U.S. Pat. No. 4,068,737. These ground based systems have the advantage of easy mobility, but all share the obvious shortcoming of being severely limited in the height to which the platform may be raised, which is generally limited to a very few stories of building elevation.

Alternatively, ground based systems may utilize scaffolding supports that are built-up from sections in order to reach variable heights. A typical example is that seen in U.S. Pat. No. 4,294,332, in which rectangular scaffolding sections may be built up alongside a platform that climbs the scaffold sections by means of a rack and pinion system. A suspension platform design has also been designed, in which chains hooked to the scaffold section, or towers, serves to raise the platform.

Safety is of paramount concern when working from an elevated, or suspended, work platform. Prior art devices share many severe safety shortcomings. Firstly, modular sections should be easily raised and locked into position from inside the relative safety of the work platform. Such modular sections should be easily connected by secure, yet easily releasable connections that do not require a worker to struggle or lean outside of the work platform boundary. Secondly, the modular sections must be readily attachable to the vertical surface alongside of which the sections, or towers, are erected, in order to allow significant height to be achieved safely. Thirdly, redundant safety systems are highly desirable, to prevent the work platform from accidentally falling in case of equipment malfunction such as a separation of the hoisting and safety locking mechanism into separate components, and most desirably with more than a single safety lock system.

What has been missing in the art has been a system by which a self erecting work platform may be raised on a tower system of easily interlocking sections, all of which may be easily raised from within the safety of the work platform, and which utilizes a motor and cable lift to raise and lower the platform system that is entirely separate from the safety lock mechanisms that operate to lock the work platform in place while tower sections are being added or removed.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The present invention is a self-erecting suspension platform system intended for use in the construction, maintenance, and cleaning of structures, or any other access solution. The platform system comprises a work platform suspended between a sinistral modular mast and a dextral modular mast by a hoisting system.

The sinistral modular mast and the dextral modular mast are each composed of at least two mast units stacked vertically and attached to one another. Each mast unit has a distal end, a proximal end, a multifunction rail extending from the distal end to the proximal end including a plurality of safety engagement devices and a stabilizer guide device, a unit interconnection device located substantially near the distal end, and a unit assembly guide. When the mast units are stacked upon one another the multifunction rail of each mast unit substantially aligns with the multifunction rail of the adjacent mast unit. The modular mast units may be virtually any shape and configuration.

The work platform serves as the stage upon which a user, or users, works to construct walls, wash windows, or any number of other elevated tasks. The work platform has a sinistral end and a dextral end. The work platform is designed to be suspended between the sinistral modular mast and the dextral modular mast. Therefore, the distance from the sinistral end to the dextral end of the work platform is less than, or substantially equal to, the mast separation distance. The work platform also has a sinistral mast stabilizer and a dextral mast stabilizer attached to the platform and is configured to cooperate with the sinistral and dextral mast stabilizer guide devices of the sinistral and dextral mast multifunction rails to prevent undesired swaying of the suspended work platform. The work platform also has a sinistral platform mast engager and a dextral platform mast engager attached to the platform and configured to cooperate with at least one of the plurality of sinistral and dextral mast safety engagement devices of the sinistral and dextral mast multifunction rails to releasably lock the platform to the modular mast thereby preventing unintentional descent of the platform.

The hoisting system suspends the working platform from the modular masts. The hoisting system includes a sinistral carriage, a dextral carriage, a sinistral mast hoist, a dextral mast hoist, a sinistral mast cable, and a dextral mast cable. Each carriage is adapted to cooperatively receive the associated modular mast so that the carriage may be conveniently slid up and down the associated modular mast by a user. Each carriage also has a proximal end, a distal end, a body, a cable connector, a carriage mast engager, and may optionally include an operator handle. The carriage mast engager is configured to releasably lock the carriage to the associated modular mast thereby preventing unintentional descent of the carriage.

The mast hoists are attached to the working platform and the associated mast cable, which is then attached to the cable connector of the associated carriage thereby suspending the working platform from the carriages. The mast hoists adjust the elevation of the working platform by extending and retracting the mast cables.

Lastly, the platform system includes at least one control system. The control system may have a central control station for user control. The central console station is in communication with each mast hoist to control the elevation of the work platform. In other another embodiment, the mast hoists are in communication with separate control systems to control the elevation of the work platform.

These variations, modifications, alternatives, and alterations of the various preferred embodiments may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

Figure 43:
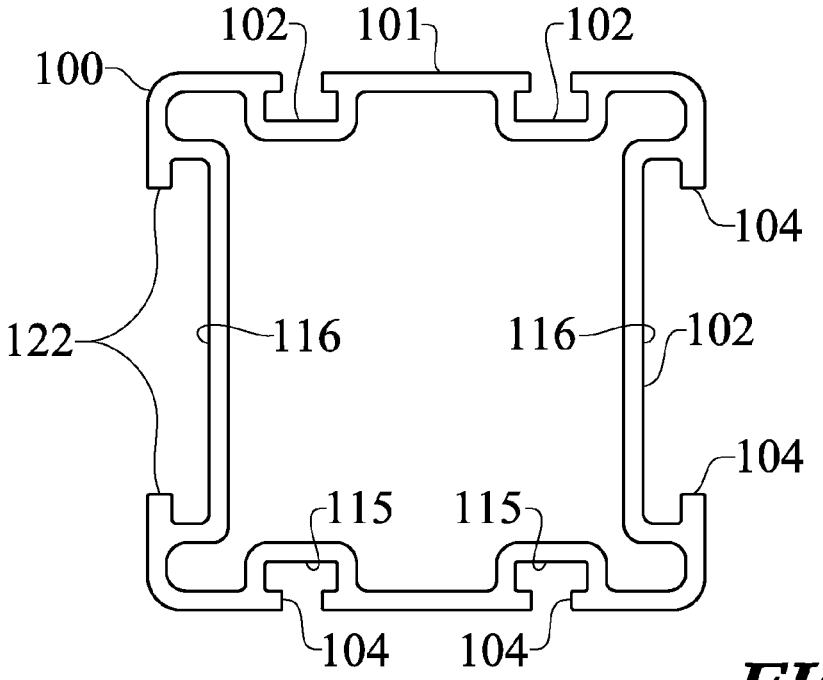
FIG. 43 is a top plan view of an embodiment of the sinistral modular mast, not to scale.
Figure 43A:
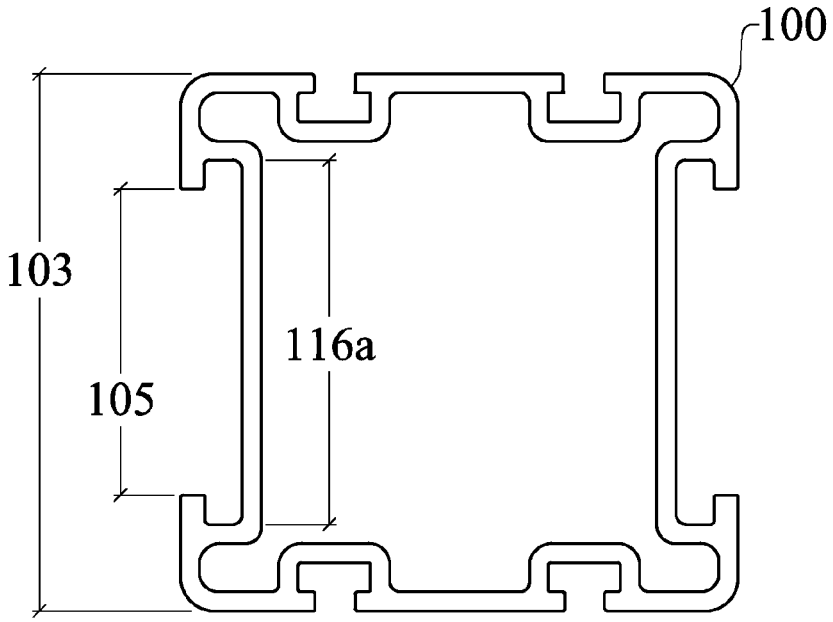
Figure 43B:
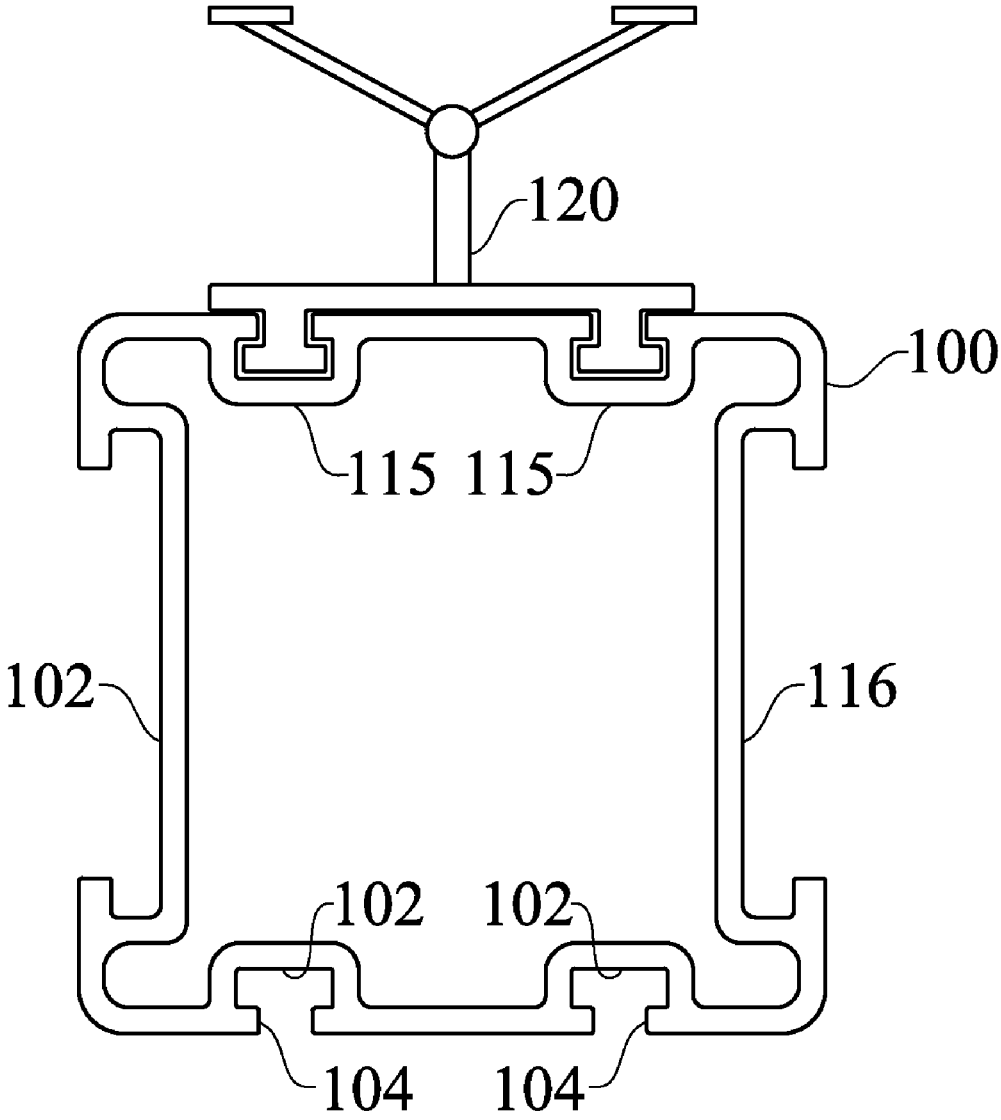
Figure 44:
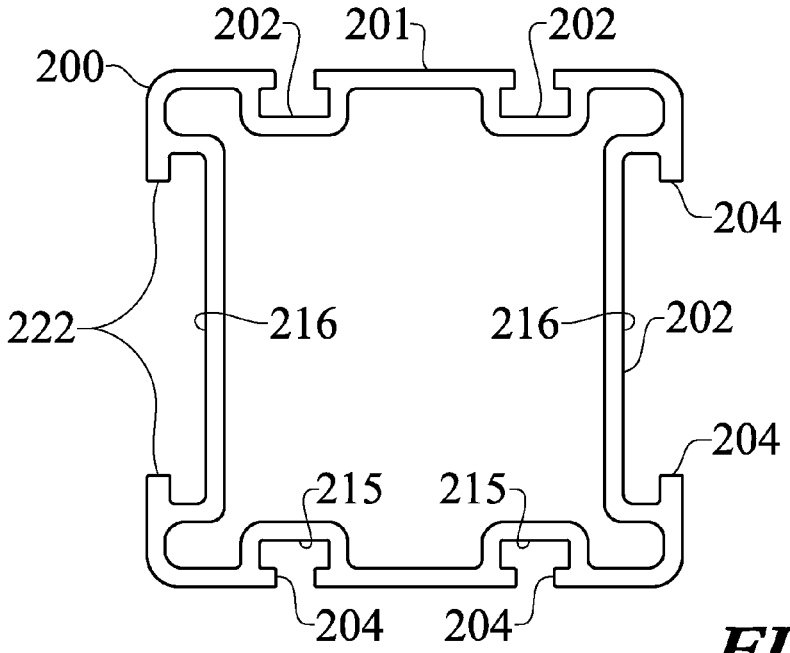
Figure 44A:
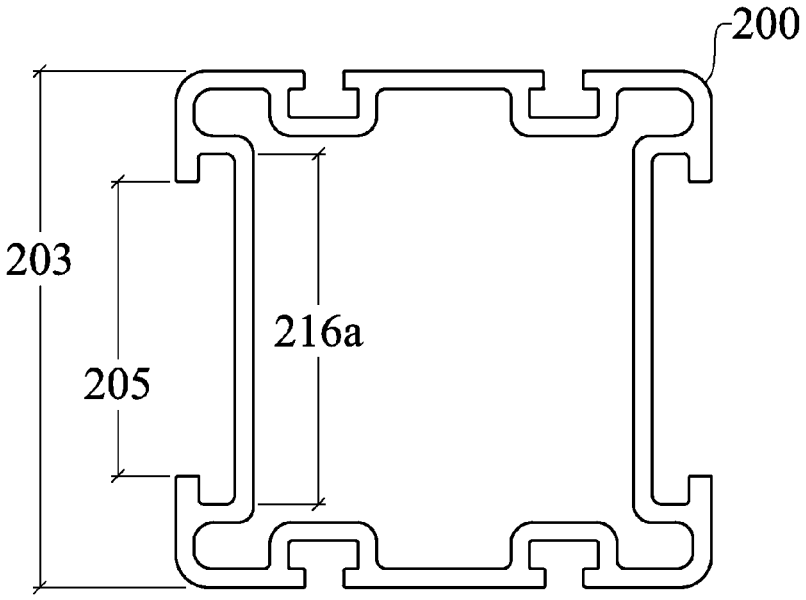
Figure 44B:
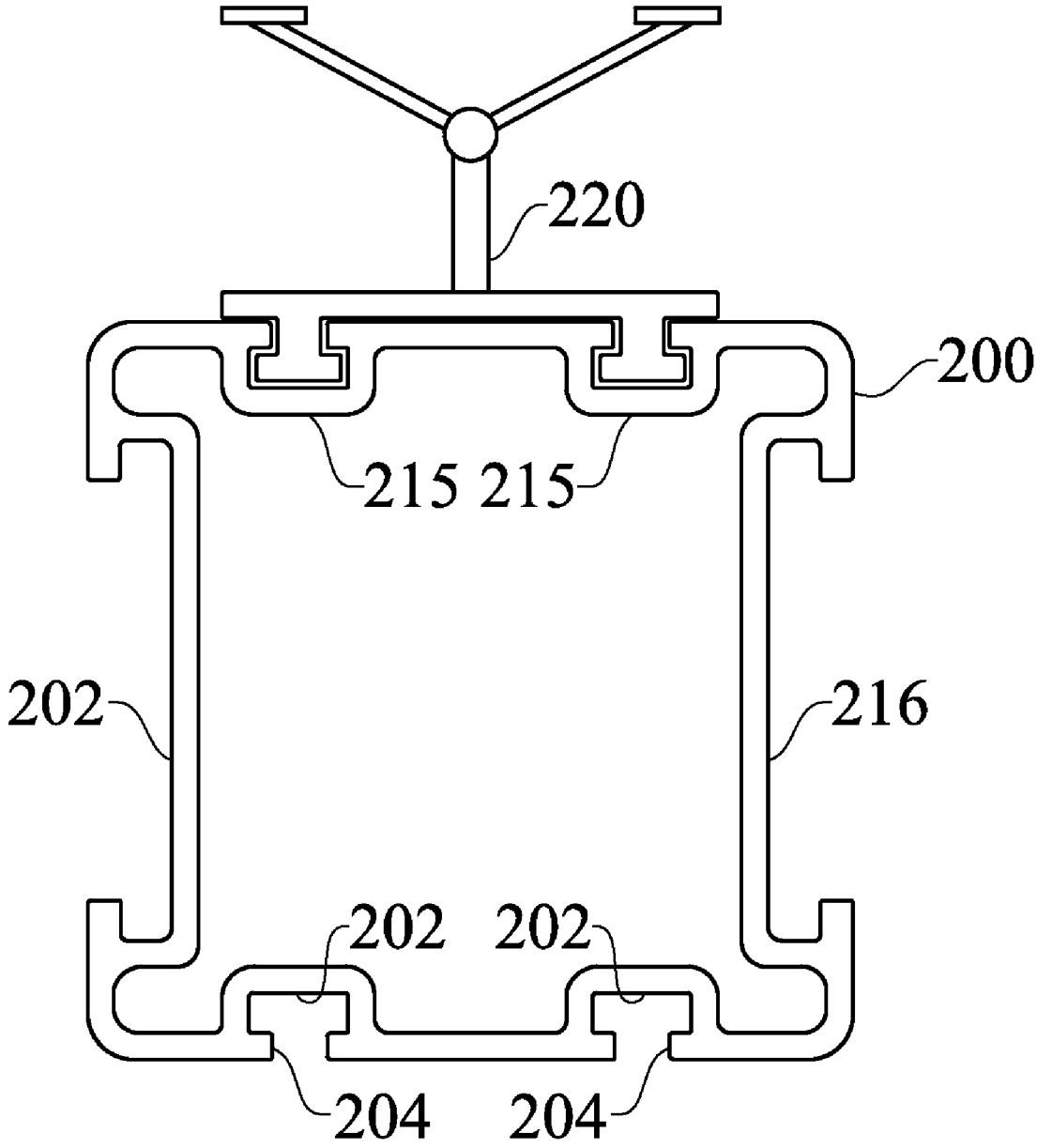
Figure 45:
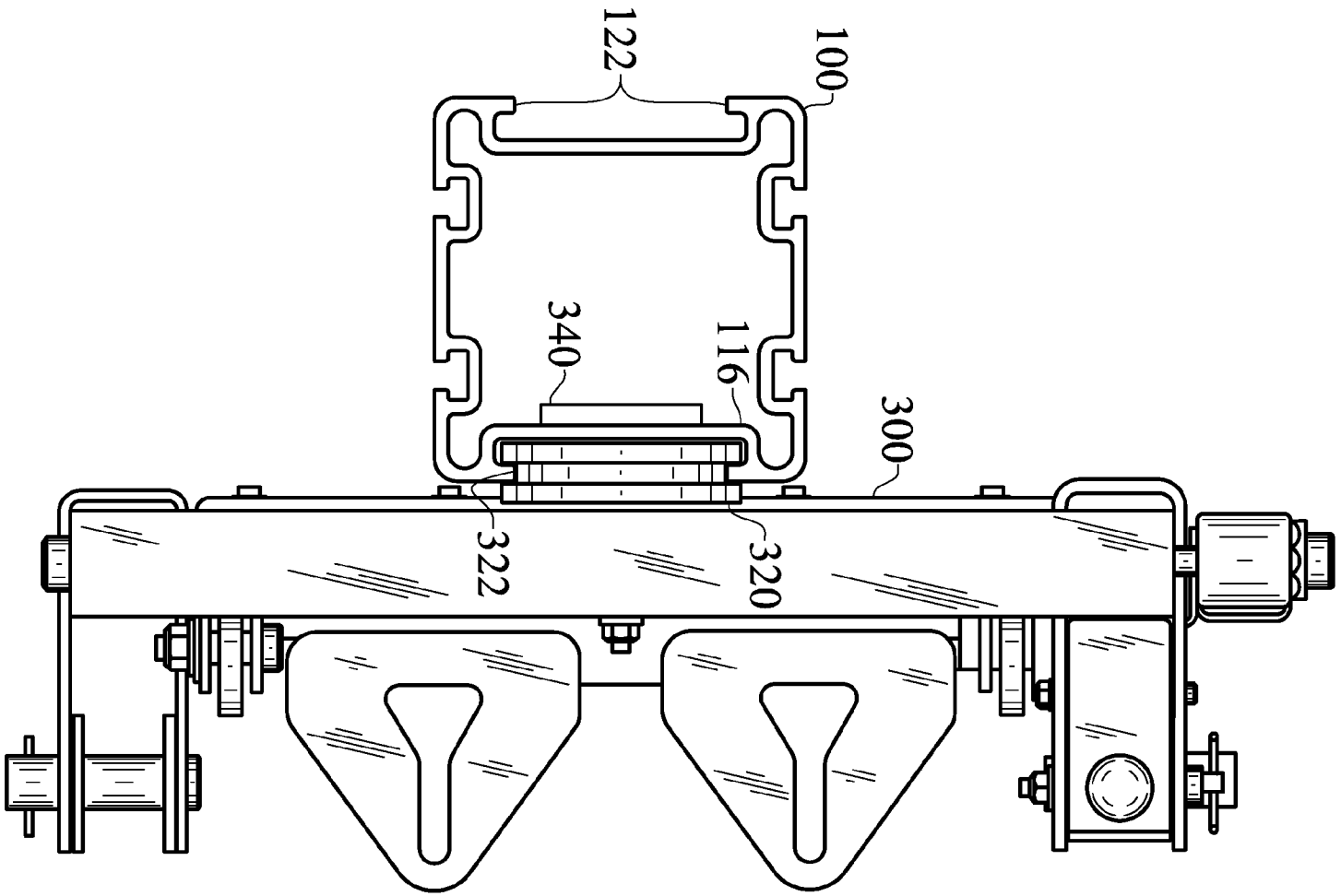
Figure 46:
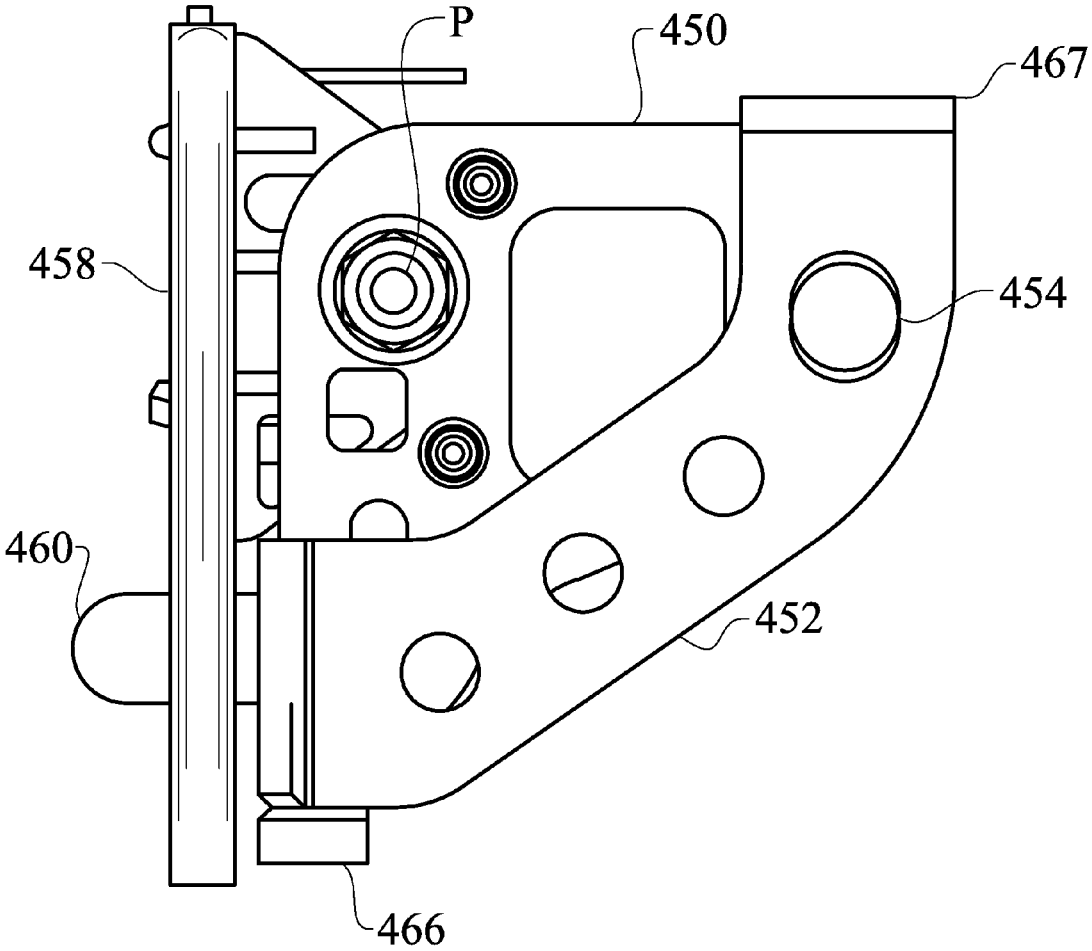
Figure 47:
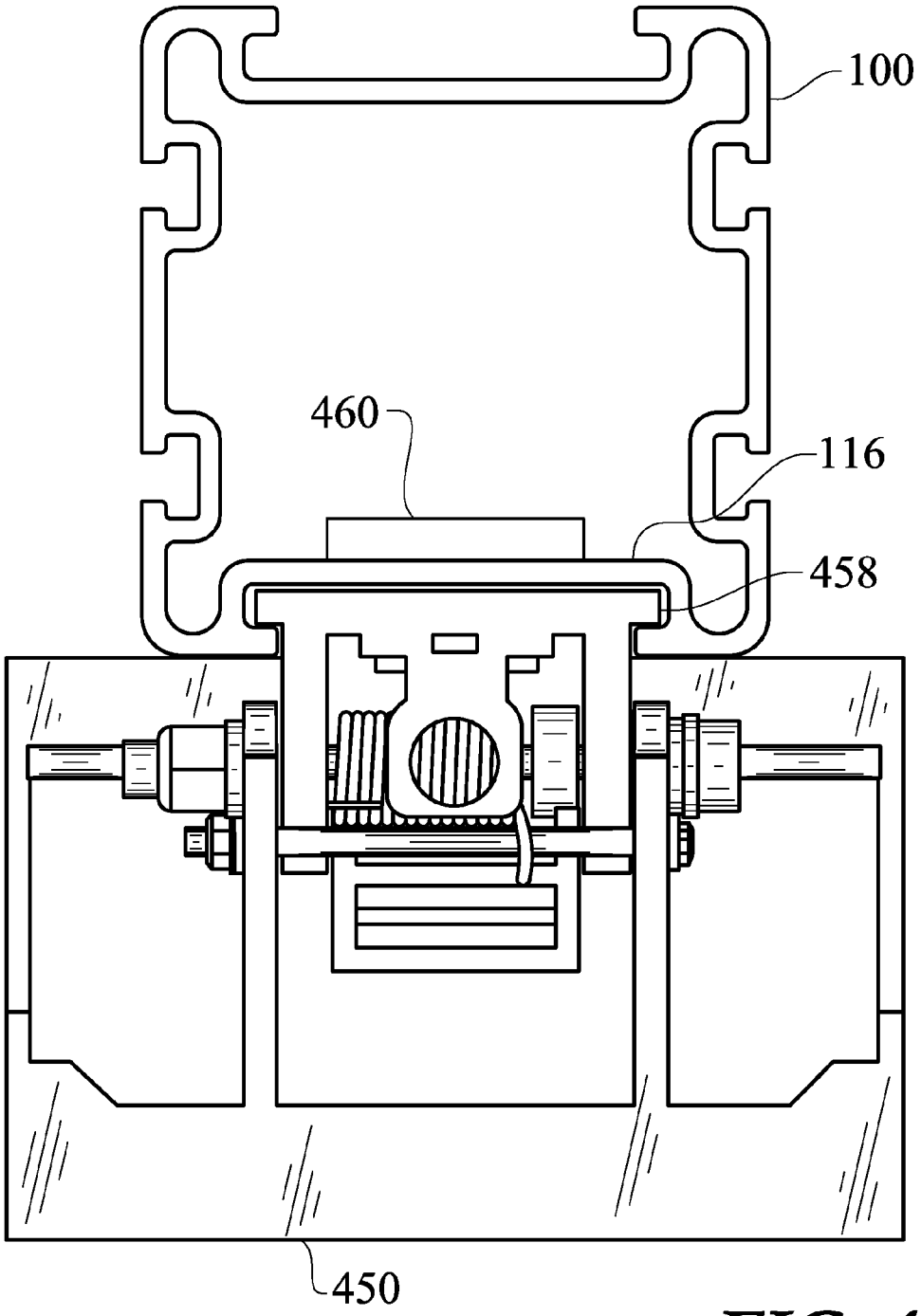

FIG. **43*a*** is a top plan view of an embodiment of the sinistral modular mast, not to scale;

FIG. 43*b* is a top plan view of an embodiment of the sinistral modular mast and an anchoring device, not to scale;

FIG. 44 is a top plan view of an embodiment of the dextral modular mast, not to scale;

FIG. 44*a* is a top plan view of an embodiment of the dextral modular mast, not to scale;

FIG. 44*b* is a top plan view of an embodiment of the dextral modular mast and an anchoring device, not to scale;

FIG. 45 is a top plan view of a portion of the work platform joined to an embodiment of the sinistral modular mast, not to scale;

FIG. 46 is a side elevation view of an embodiment of the sinistral carriage, not to scale; and FIG. 47 is a top plan view of an embodiment of the sinistral carriage joined to an embodiment of the sinistral modular mast, not to scale.

DETAILED DESCRIPTION OF THE INVENTION

The self-erecting suspension platform system (10) of the instant invention enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
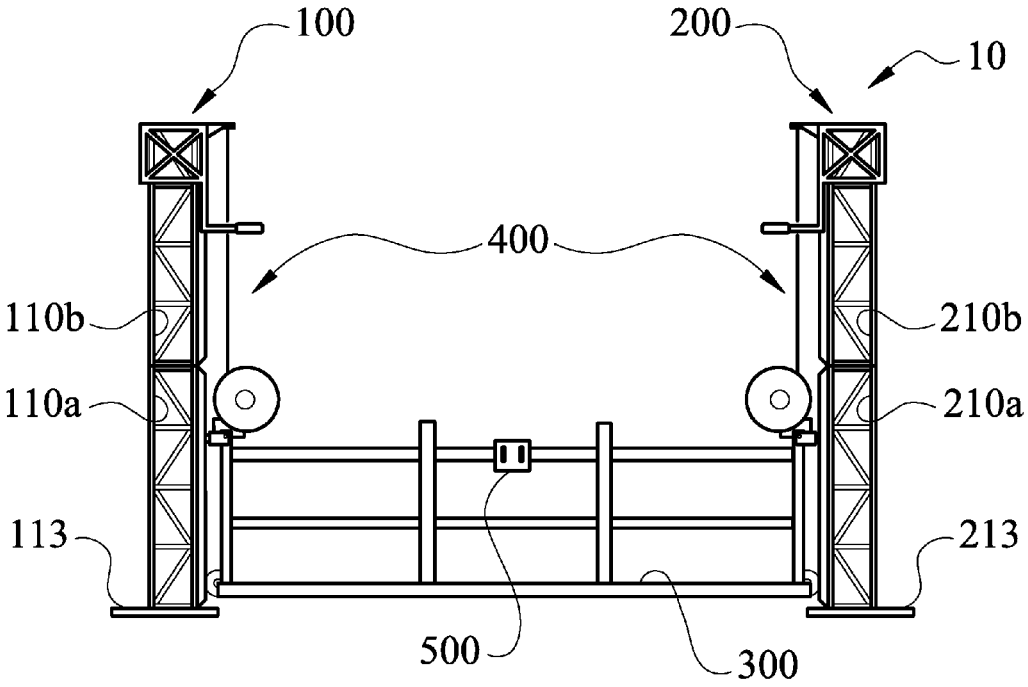
FIG. 1 is a schematic side elevation view of the self-erecting suspension platform, not to scale.

The present invention is a self-erecting suspension platform system (10) intended for use in the construction, maintenance, and cleaning of structures, or any other access solution. With reference to FIG. 1, the platform system (10) comprises a work platform (300) located between a sinistral modular mast (100) and a dextral modular mast (200), wherein a hoisting system (400) suspends the work platform (300) from the modular masts (100, 200).

Figure 31:
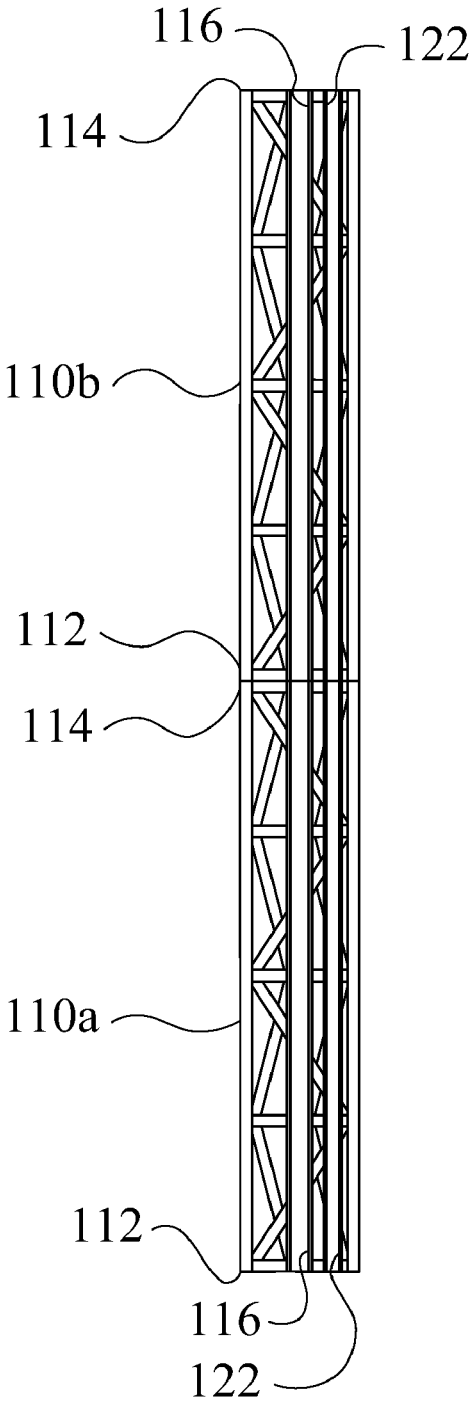
FIG. 31 is a schematic front elevation view of a portion of the sinistral modular mast, not to scale.

First, the modular masts (100, 200) will be disclosed in detail. The sinistral modular mast (100), illustrated in FIG. 7, has at least a second sinistral mast unit (110*b*) stacked vertically on, and releasably attached to, a first sinistral mast unit (110*a*). The first sinistral mast unit (110*a*) and the second sinistral mast unit (110*b*) are substantially identical. Each sinistral mast unit (110*a*, 110*b*) has a distal end (112), a proximal end (114), a multifunction rail (116) extending from the distal end (112) to the proximal end (114) including a plurality of safety engagement devices (117) and a stabilizer guide device (122), which is illustrated in FIG. 31 only, a unit interconnection device (135), seen in FIG. 7, located substantially near the distal end (112), and a unit assembly guide (140) located substantially near the distal end (112). When the sinistral mast units (110*a*, 110*b*) are stacked upon one another the multifunction rails (116) of each mast unit (110*a*, 110*b*) substantially align. The sinistral modular mast (100) is constructed on a sinistral base plate (113) in contact with the ground for stability and to distribute the load of the sinistral modular mast (100).

Figure 8:
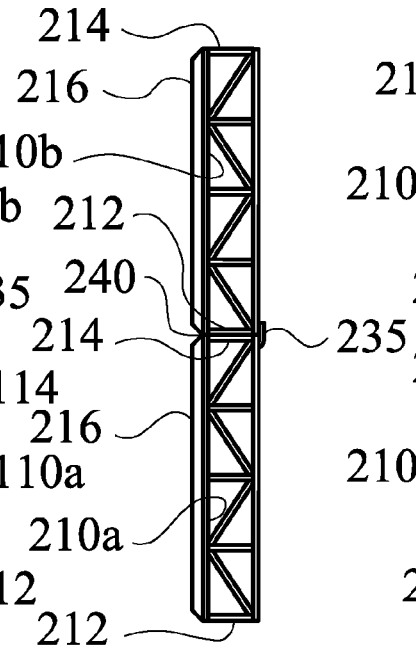
FIG. 8 is a schematic side elevation view of a portion of the dextral modular mast, not to scale.
Figure 9:
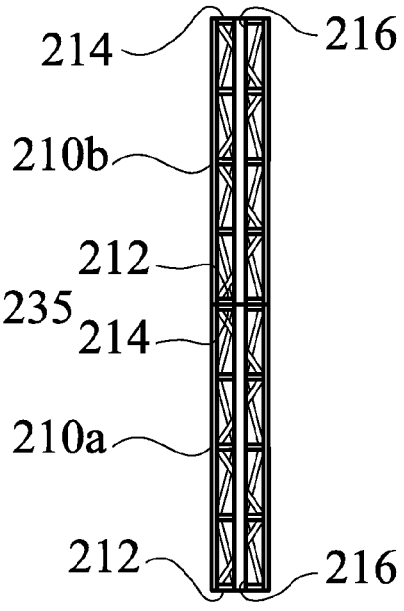
FIG. 9 is a schematic front elevation view of a portion of the dextral modular mast, not to scale.

Similarly, the dextral modular mast (200), seen in FIGS. 8 and 9, has at least a second dextral mast unit (210*b*) stacked vertically on, and releasably attached to, a first dextral mast unit (210*a*). The first dextral mast unit (210*a*) and the second dextral mast unit (210*b*) are substantially identical, and are substantially identical to the sinistral mast units (110*a*, 110*b*). Each dextral mast unit (210*a*, 210*b*) has a distal end (212), a proximal end (214), a multifunction rail (216) extending from the distal end (212) to the proximal end (214) including a plurality of safety engagement devices (217) and a stabilizer guide device (222), seen only in FIG. 32, a unit interconnection device (235) located substantially near the distal end (212), and a unit assembly guide (240) located substantially near the distal end (212). When the dextral mast units (210*a*, 210*b*) are stacked upon one another the multifunction rails (216) of each mast unit (210*a*, 210*b*) substantially align. The dextral modular mast (200) is constructed on a dextral base plate (213) in contact with the ground for stability and to distribute the load of the dextral modular mast (200). Further, one with skill in the art will appreciate that the multifunction rails (116, 216) need not be located at the middle of one of the sides of the modular masts (100, 200). In fact, by offsetting the multifunction rails (116, 216) the working platform (300) may be placed closer to the structure upon which work is being performed.

Figure 3:
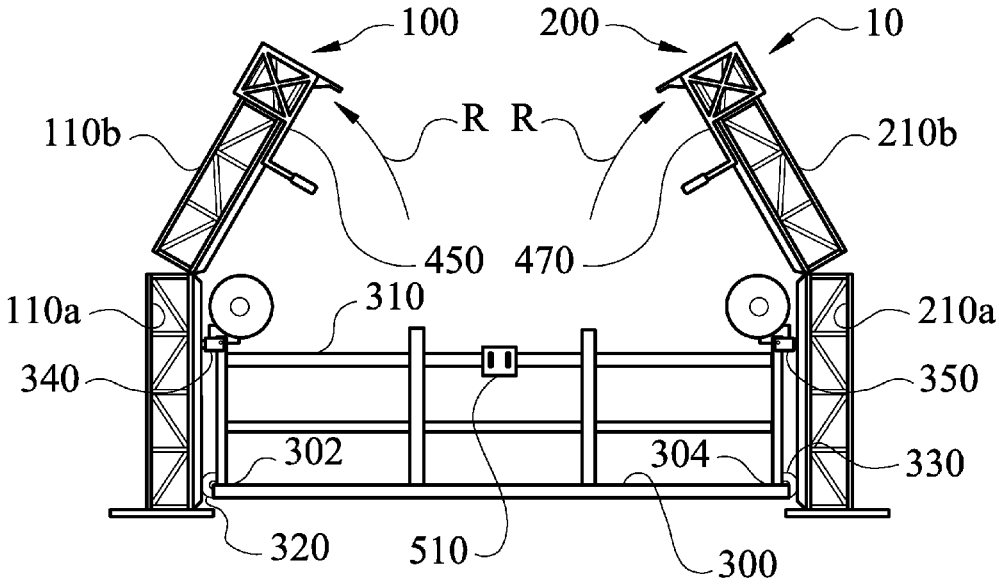
FIG. 3 is a schematic side elevation view of the self-erecting suspension platform, not to scale.
Figure 7:
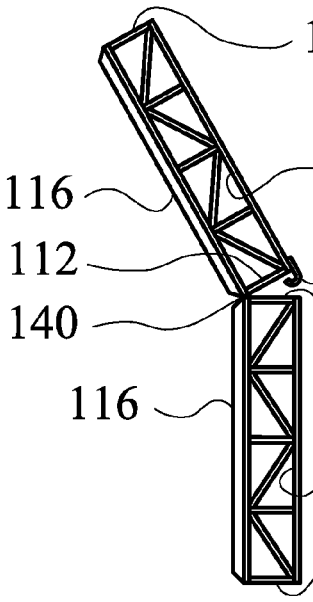
FIG. 7 is a schematic side elevation view of a portion of the sinistral modular mast, not to scale.

The sinistral mast units (110*a*, 110*b*) are configured such that when a portion of the distal end (112) of a second sinistral mast unit (110*b*) is placed in contact with the proximal end (114) of the adjacent first sinistral mast unit (110*a*), during assembly of the sinistral modular mast (100), the unit assembly guide (140) pivotably secures the second sinistral mast unit (110*b*) to the first sinistral mast unit (110*a*) such that the second sinistral mast unit (110*b*) may be securely rotated into a vertical position such that the sinistral unit interconnection device (135) attaches the second sinistral mast unit (110*b*) to the first sinistral mast unit (110*a*), as seen in FIG. 7. Similarly, the dextral mast units (210*a*, 210*b*), illustrated best in FIGS. 3, 8, and 9, are configured such that when a portion of the distal end (212) of a second dextral mast unit (210*b*) is placed in contact with the proximal end (214) of the adjacent first dextral mast unit (210*a*), during assembly of the dextral modular mast (200), the unit assembly guide (240) pivotably secures the second dextral mast unit (210*b*) to the first dextral mast unit (210*a*) such that the second dextral mast unit (210*b*) may be securely rotated into a vertical position such that the dextral unit interconnection device (235) attaches the second dextral mast unit (210*b*) to the first dextral mast unit (110*a*). The dextral modular mast (200) is separated from the sinistral modular mast (100) by a mast separation distance (50).

As one with skill in the art will recognize, the modular mast units (110*a*, 110*b*, 210*a*, 210*b*) may be virtually any shape and configuration. The design and construction of the modular mast units (110*a*, 110*b*, 210*a*, 210*b*) depends largely on the size and load of the work platform (300), as well as the elevation that the work platform (300) must reach. For example, the modular mast units (110*a*, 110*b*, 210*a*, 210*b*) may be a predetermined size and configuration for use with ten foot long work platforms (300) that will reach an elevation of no more than sixty feet. Further, then modular mast units (110*a*, 110*b*, 210*a*, 210*b*) for use with longer more heavily loaded work platforms (300) may be a different configuration and level of reinforcing such that for safety concerns the modular mast units (110*a*, 110*b*, 210*a*, 210*b*) of one particular work platform (300) and application criteria may not be used with modular mast units (110*a*, 110*b*, 210*a*, 210*b*) of a different work platform (300) and application criteria. As with many structural tower systems, generally a triangular cross-sectioned truss construction tower provides the greatest utility, however any number of widely known structural shapes may be used.

Figure 33:
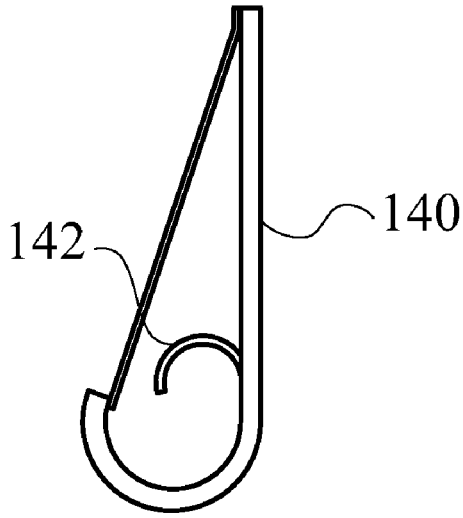
FIG. 33 is a schematic side elevation view of an embodiment of a unit assembly guide, not to scale.
Figure 34:
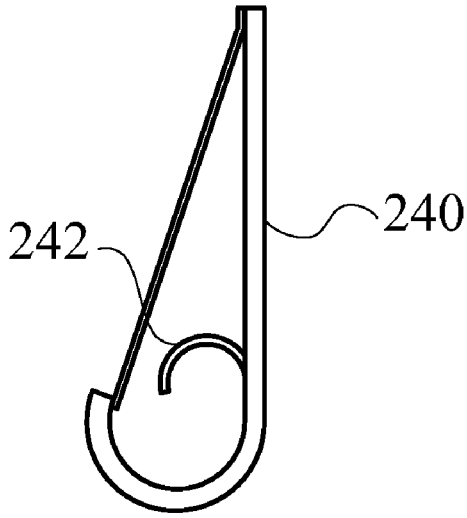
FIG. 34 is a schematic side elevation view of an embodiment of a unit assembly guide, not to scale.

Further, the unit assembly guides (140, 240) may be constructed in any number of effective arrangements. In one embodiment, the unit assembly guides (140, 240) includes a hook device (142, 242), seen in FIGS. 33 and 34, located substantially near the distal end (112, 212) and configured such that when a portion of the distal end (112, 212) of a second mast unit (110*b*, 210*b*) is placed in contact with the proximal end (114, 214) of the adjacent first mast unit (110*a*, 210*a*) in the vertical position that the hook device (142, 242) pivotably secures the second mast unit (110*b*, 210*b*) to the first mast unit (110*a*, 210*a*) such that the second mast unit (110*b*, 210*b*) may be securely rotated into a vertical position such that the unit interconnection device (135, 235) attaches the second mast unit (110*b*, 210*b*) to the first mast unit (110*a*, 210*a*). Similarly, the unit interconnection devices (135, 235) may be constructed in any number of effective arrangements. Perhaps the most simple embodiment of the unit interconnection devices (135, 235) barb-type finger, as seen in FIGS. 7 and 8, that deflects and snaps over a portion of the adjacent mast unit (110*a*, 110*b*, 210*a*, 210*b*), and requires intentional manipulation of the finger to release the adjacent mast unit (110*a*, 110*b*, 210*a*, 210*b*).

Next, with reference again to FIG. 1, the work platform (300) serves as the stage upon which a user, or users, works to construct walls, wash windows, or any number of other elevated tasks. The work platform (300) has a sinistral end (302) and a dextral end (304), as seen in FIG. 3. Since the work platform (300) is designed to be suspended between the sinistral modular mast (100) and the dextral modular mast (200), the distance from the sinistral end (302) to the dextral end (304) of the work platform (300) is less than, or substantially equal to, the mast separation distance (50), shown in FIG. 5. The work platform (300) is located between the sinistral modular mast (100) and the dextral modular mast (200) such that the work platform sinistral end (302) is adjacent to the sinistral modular mast (100) and the work platform dextral end (304) is adjacent to the dextral modular mast (200). The work platform (300) has a railing (310), seen in FIG. 3. The work platform (300) also has a sinistral mast stabilizer (320) and a dextral mast stabilizer (330) attached to the platform (300) and configured to cooperate with the sinistral and dextral mast stabilizer guide device (122, 222), seen in FIGS. 31 and 32, of the sinistral and dextral mast multifunction rails (116, 216) to prevent undesired swaying of the suspended work platform (300). Additionally, the work platform (300) has a sinistral platform mast engager (340) and a dextral platform mast engager (350) attached to the platform (300) and configured to cooperate with at least one of the plurality of sinistral and dextral mast safety engagement devices (117, 217) of the sinistral and dextral mast multifunction rails (116, 216) to releasably lock the platform (300) to the modular mast (100, 200) thereby preventing unintentional descent of the platform (300).

Figure 2:
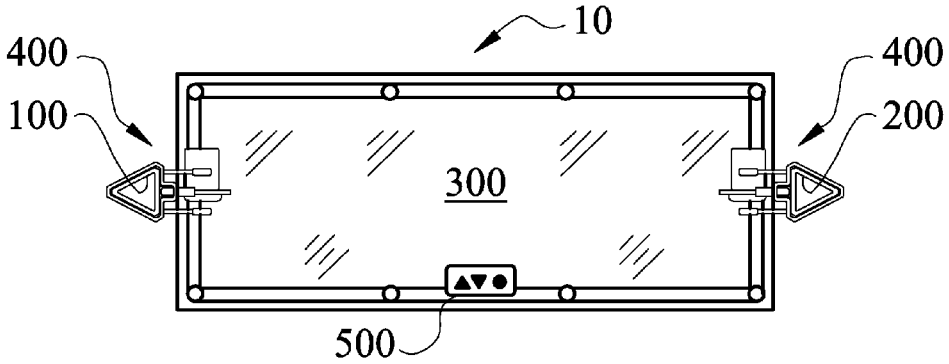
FIG. 2 is a schematic top plan of the self-erecting suspension platform, not to scale.
Figure 4:
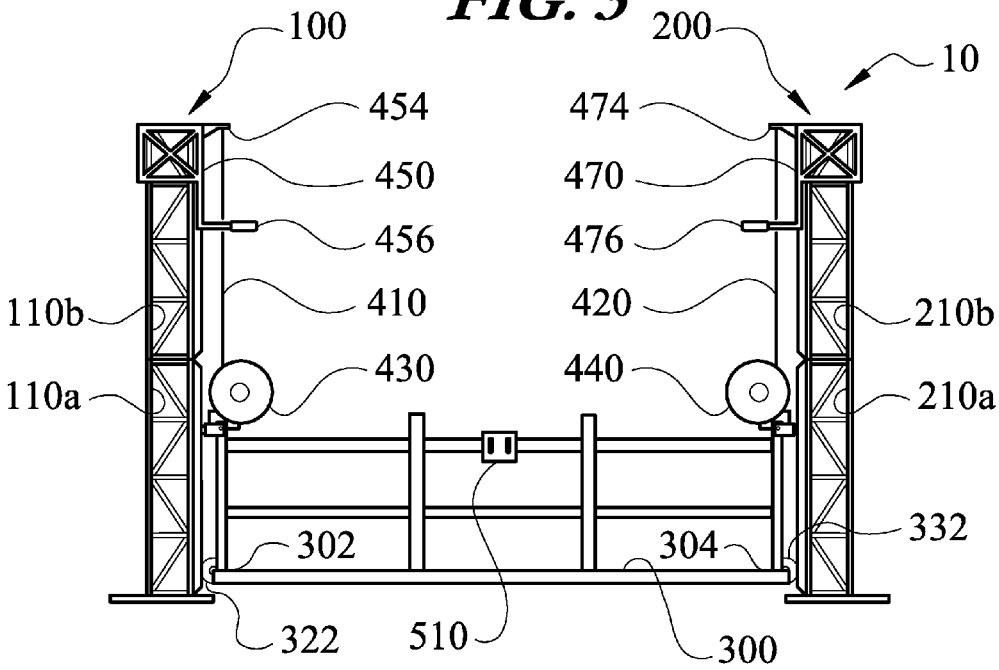
FIG. 4 is a schematic side elevation view of the self-erecting suspension platform, not to scale.

With reference now to FIGS. 2 and 4, the hoisting system (400) suspends the working platform (300) from the sinistral modular mast (100) and the dextral modular mast (200). The hoisting system (400) includes (a) a sinistral carriage (450), (b) a dextral carriage (470), (c) a sinistral mast hoist (430), (d) a dextral mast hoist (440), (e) a sinistral mast cable (410), and (f) a dextral mast cable (420).

Figure 10:
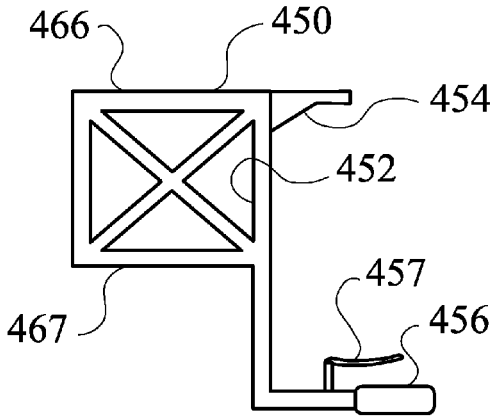
FIG. 10 is a schematic side elevation view of an embodiment of the sinistral carriage, not to scale.
Figure 12:
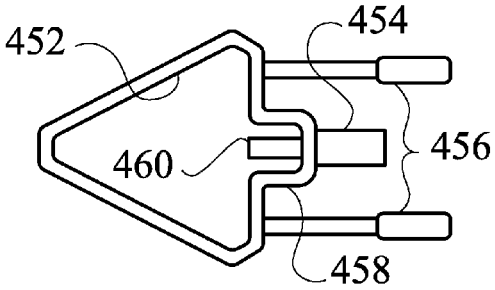
FIG. 12 is a schematic top plan view of an embodiment of the sinistral carriage, not to scale.
Figure 14:
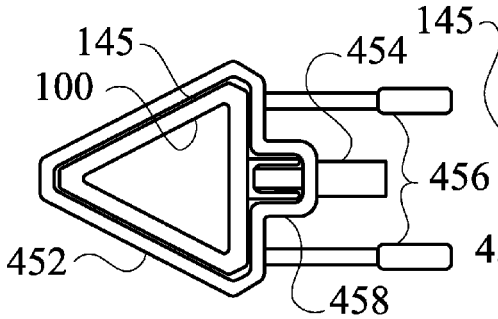
FIG. 14 is a schematic top plan view of an embodiment of the sinistral carriage, not to scale.

The sinistral carriage (450) is adapted to cooperatively receive the sinistral modular mast (100) so that the sinistral carriage (450) may be conveniently slid up and down the sinistral modular mast (100) by a user. As seen in FIGS. 10, 12, and 14, the sinistral carriage (450) has a proximal end (466), a distal end (467), a body (452), a cable connector (454), a carriage mast engager (460), and may optionally include an operator handle (456). The carriage mast engager (460) is configured to releasably lock the sinistral carriage (450) to the sinistral modular mast (100) thereby preventing unintentional descent of the sinistral carriage (450).

Figure 11:
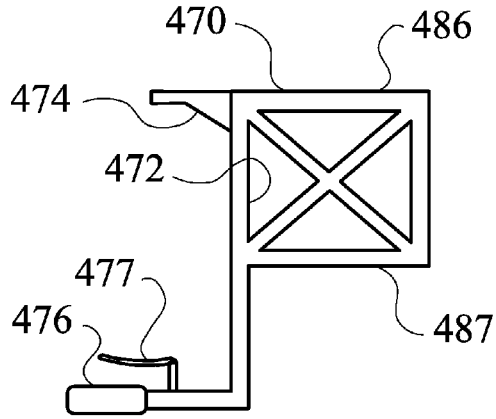
FIG. 11 is a schematic side elevation view of an embodiment of the dextral carriage, not to scale.
Figure 13:
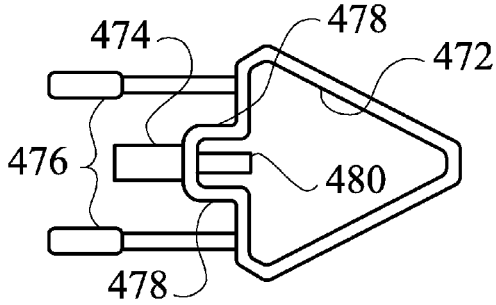
FIG. 13 is a schematic top plan view of an embodiment of the sinistral carriage, not to scale.

The dextral carriage (470) is adapted to cooperatively receive the dextral modular mast (200) so that the dextral carriage (470) may be conveniently slid up and down the dextral modular mast (200) by a user. As seen in FIGS. 11 and 13, the dextral carriage (470) has a proximal end (486), a distal end (487), a body (472), a cable connector (474), an operator handle (476), and a carriage mast engager (480) to releasably lock the dextral carriage (470) to the dextral modular mast (200) thereby preventing unintentional descent of the dextral carriage (470).

Referring again to FIG. 4, the sinistral mast hoist (430) is attached to the working platform (300) near the sinistral end (302) and the dextral mast hoist (440) is attached to the working platform (300) near the dextral end (304). Further, the sinistral mast cable (410) is attached to the cable connector (454) of the sinistral carriage (450) and the sinistral mast hoist (430) and the dextral mast cable (420) is attached to the cable connector (474) of the dextral carriage (470) and the dextral mast hoist (440) thereby suspending the working platform (300) from the sinistral carriage (450) and the dextral carriage (470). In one embodiment, the mast hoists (430, 440) adjust the elevation of the working platform (300) by extending and retracting the sinistral mast cable (410) from the sinistral mast hoist (430) and the dextral mast cable (420) from the dextral mast hoist (440). However, in another embodiment, the mast hoists (430, 440) may be traction type hoists that climb up and down the length of the mast cables (410, 420). The mast hoists (430, 440) are generally commercially available electrically powered hoists, but they may be manual hoist systems or air powered hoist systems.

The platform system (10) includes at least one control system (500) in communication with the sinistral mast hoist (430) and the dextral mast hoist (440). The at least one control system (500) operates the sinistral mast hoist (430) and the dextral mast hoist (440) to control the elevation of the work platform (300). In a particular embodiment, the control system (500) includes a central control station (510) for user control, as seen in FIGS. 2 and 3. The central console station (510) is in communication with the sinistral mast hoist (430) and the dextral mast hoist (440) to control the elevation of the work platform (300) by operating the sinistral mast hoist (430) and the dextral mast hoist (440). The central control station (510) may be used to operate the sinistral mast hoist (430) and the dextral mast hoist (440) separately or simultaneously.

In another embodiment, the platform system (10) includes a sinistral control system and a dextral control system. In this embodiment, the sinistral control system is in communication with the sinistral mast hoist (430) and is used to operate the sinistral mast hoist (430), while the dextral control system is in communication with the dextral mast hoist (440) and is used to operate the dextral mast hoist (440). Thus, each mast hoist (430, 440) may have its own control system (500) for operating the mast hoist (430, 440) to thereby control the elevation of the work platform (300).

The control system (500) may incorporate any number of electrical interlocks for improved safety. For instance, the control system (500) may include an accelerometer that activates the sinistral and dextral platform mast engagers (340, 350) upon sensing a predetermined acceleration or velocity to secure the platform mast engagers (340, 350) to the safety engagement devices (117, 217). Additional safety features may include top limit switch(s), bottom limit switch(s), and a payload overload detection system.

Figure 20:
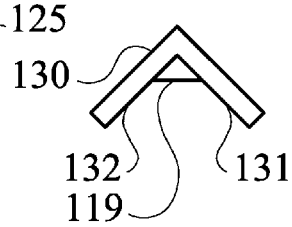
FIG. 20 is a schematic top plan view of an embodiment of the multifunction rail, not to scale.
Figure 17:
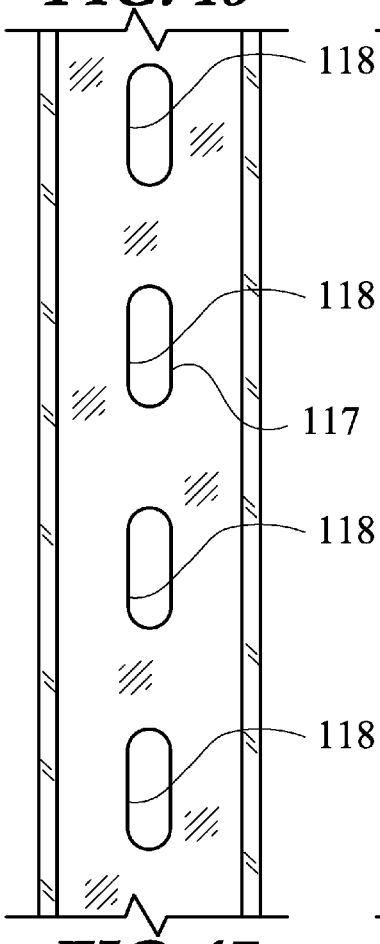
FIG. 17 is a schematic front elevation view of an embodiment of the multifunction rail, not to scale.
Figure 19:
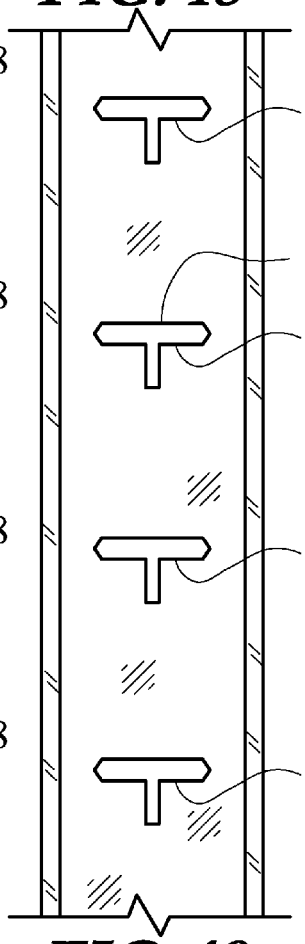
FIG. 19 is a schematic front elevation view of an embodiment of the multifunction rail, not to scale.
Figure 21:
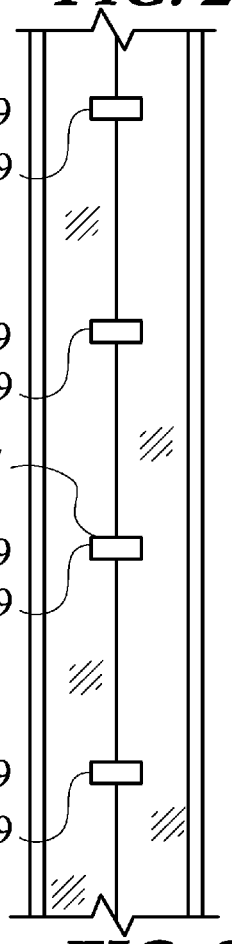
FIG. 21 is a schematic front elevation view of an embodiment of the multifunction rail, not to scale.
Figure 22:
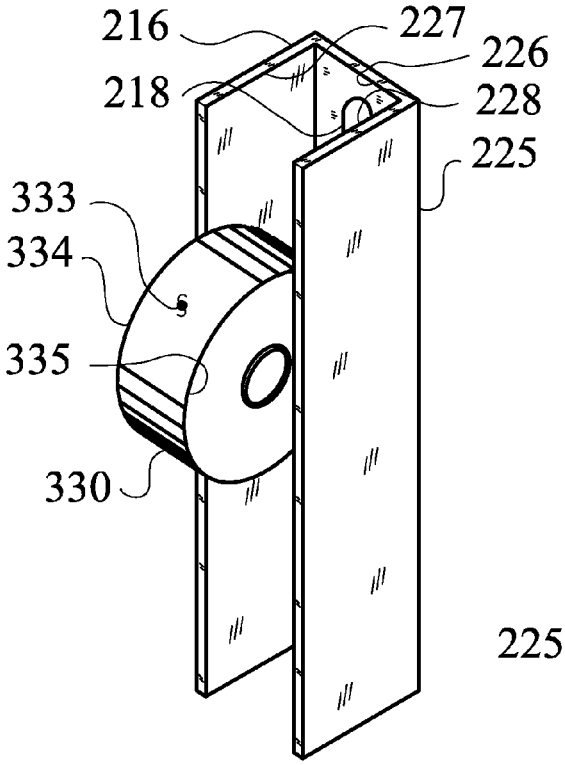
FIG. 22 is a schematic elevated perspective view of an embodiment of the multifunction rail and platform mast stabilizer, not to scale.
Figure 23:
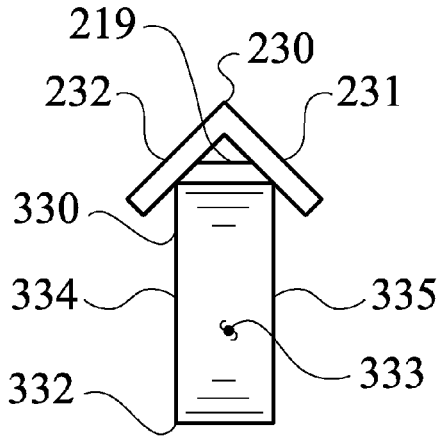
FIG. 23 is a schematic top plan view of an embodiment of the multifunction rail and platform mast stabilizer, not to scale.
Figure 24:
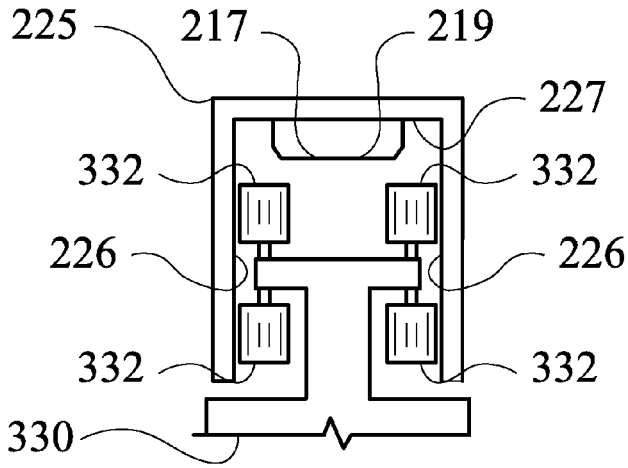
FIG. 24 is a schematic top plan view of an embodiment of the multifunction rail and platform mast stabilizer, not to scale.

Now the various elements discussed above will be reviewed in more detail and as applied to various embodiments. The plurality of safety engagement devices (117, 217) of the multifunction rails (116, 216) may be formed as locking recesses (118, 218) formed in the multifunction rail (116, 216) in some embodiments, as seen in FIGS. 17 and 22, and may be formed as locking projections (119, 219) extending from the multifunction rail (116, 216) in other embodiments, as seen in FIGS. 19, 20, and 23. The locking recesses (118, 218) of FIGS. 17 and 22 formed in the multifunction rail (116, 216) are generally openings that extend all the way through the multifunction rail (116, 216), however they may simply be recesses formed in the multifunction rail (116, 216).

Figure 25:
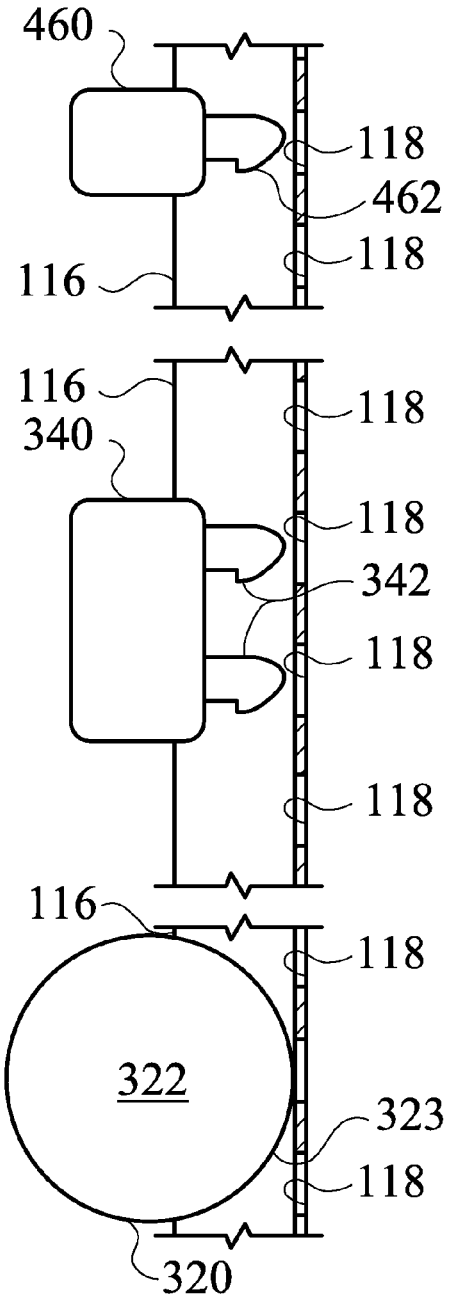
FIG. 25 is a schematic partial cross-section of several elements of the present invention, not to scale.
Figure 26:
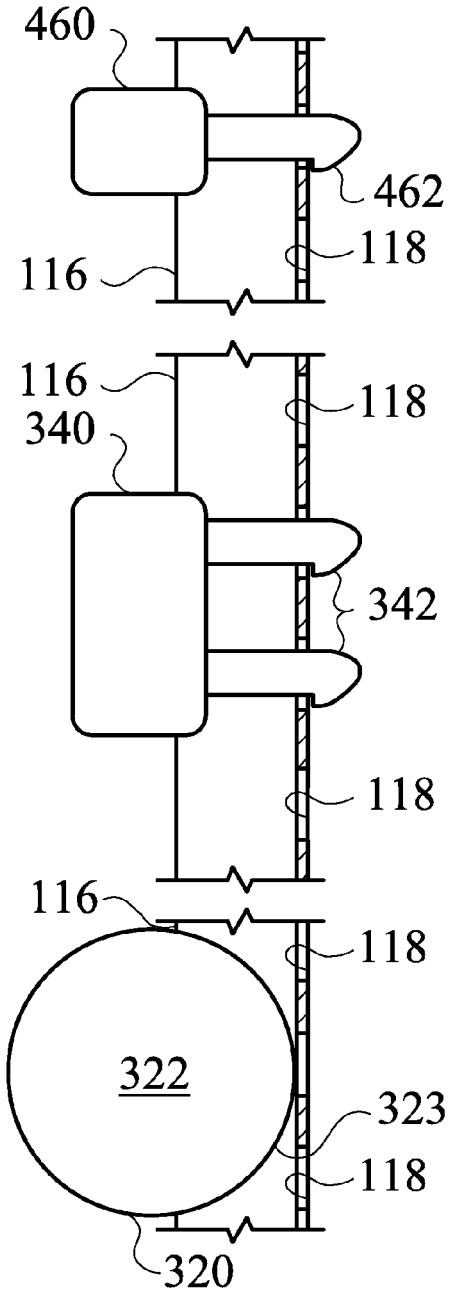
FIG. 26 is a schematic partial cross-section of several elements of the present invention, not to scale.

The sinistral carriage mast engager (460) and the dextral mast engager (480) cooperate with their associated modular mast (100, 200) to prevent unintentional descent of the carriages (450, 470). The carriage mast engagers (460, 480) may be virtually any device that can selectively lock the associated carriage (450, 470) to the associated mast (100, 200). Most embodiments the carriage mast engagers (460, 480) include some form of a locking tongue. For instance, one embodiment, illustrated in FIGS. 25 and 26, includes a sinistral carriage locking tongue (462) formed to cooperate with the sinistral locking recesses (118) so that the sinistral carriage locking tongue (462) can extend into, and retract from, any one of the sinistral locking recesses (118) to releasably secure the sinistral carriage (450) to the sinistral multifunction rail (116). Similarly, in this embodiment, the dextral carriage mast engager (480) includes a dextral carriage locking tongue (482) formed to cooperate with the dextral locking recesses (218) so that the dextral carriage locking tongue (482) can extend into, and retract from, any one of the dextral locking recesses (218) to releasably secure the dextral carriage (470) to the dextral multifunction rail (216), not illustrated but identical to FIGS. 25 and 26. However, in alternative embodiments the carriage mast engagers (460, 480) may directly attach to the mast (100, 200), not the multifunction rail (116, 216). The actuation of the carriage locking tongues (462, 482) may be manually initiated by the force of the user or may be power actuated via hydraulics, pneumatics, or electromagnetics, just to name a few power sources.

Similar to the carriage mast engagers (460, 480) just discussed, the work platform (300) incorporates a sinistral platform mast engager (340) and a dextral platform mast engager (350), seen in FIG. 3, both of which are attached to the platform (300), configured to cooperate with at least one of the plurality of sinistral and dextral mast safety engagement devices (117, 217) of the sinistral and dextral mast multifunction rails (116, 216). The platform mast engagers (340, 350) serve to releasably lock the platform (300) to the modular masts (100, 200) via the multifunction rails (116, 216) thereby preventing unintentional descent of the platform (300). Further, systematic locking of the platform (300) to the modular masts (100, 200) is required during the operation of the suspension platform system (10). The platform mast engagers (340, 350) may be virtually any device that can selectively lock the associated side of the work platform (302, 304) to the associated multifunction rail (116, 216). Most embodiments the platform mast engagers (340, 350) include some form of a locking tongue. For instance, one embodiment, illustrated in FIGS. 25 and 26, includes a sinistral platform locking tongue (342) formed to cooperate with the sinistral locking recesses (118) so that the sinistral platform locking tongue (342) can extend into, and retract from, any one of the sinistral locking recesses (118) to releasably secure the work platform sinistral end (302) to the sinistral multifunction rail (116). Similarly, in this embodiment, the dextral platform mast engager (350) includes a dextral platform locking tongue (352) formed to cooperate with the dextral locking recesses (218) so that the dextral platform locking tongue (352) can extend into, and retract from, any one of the dextral locking recesses (218) to releasably secure the work platform dextral end (304) to the dextral multifunction rail (216), not illustrated but identical to FIGS. 25 and 26.

Figure 27:
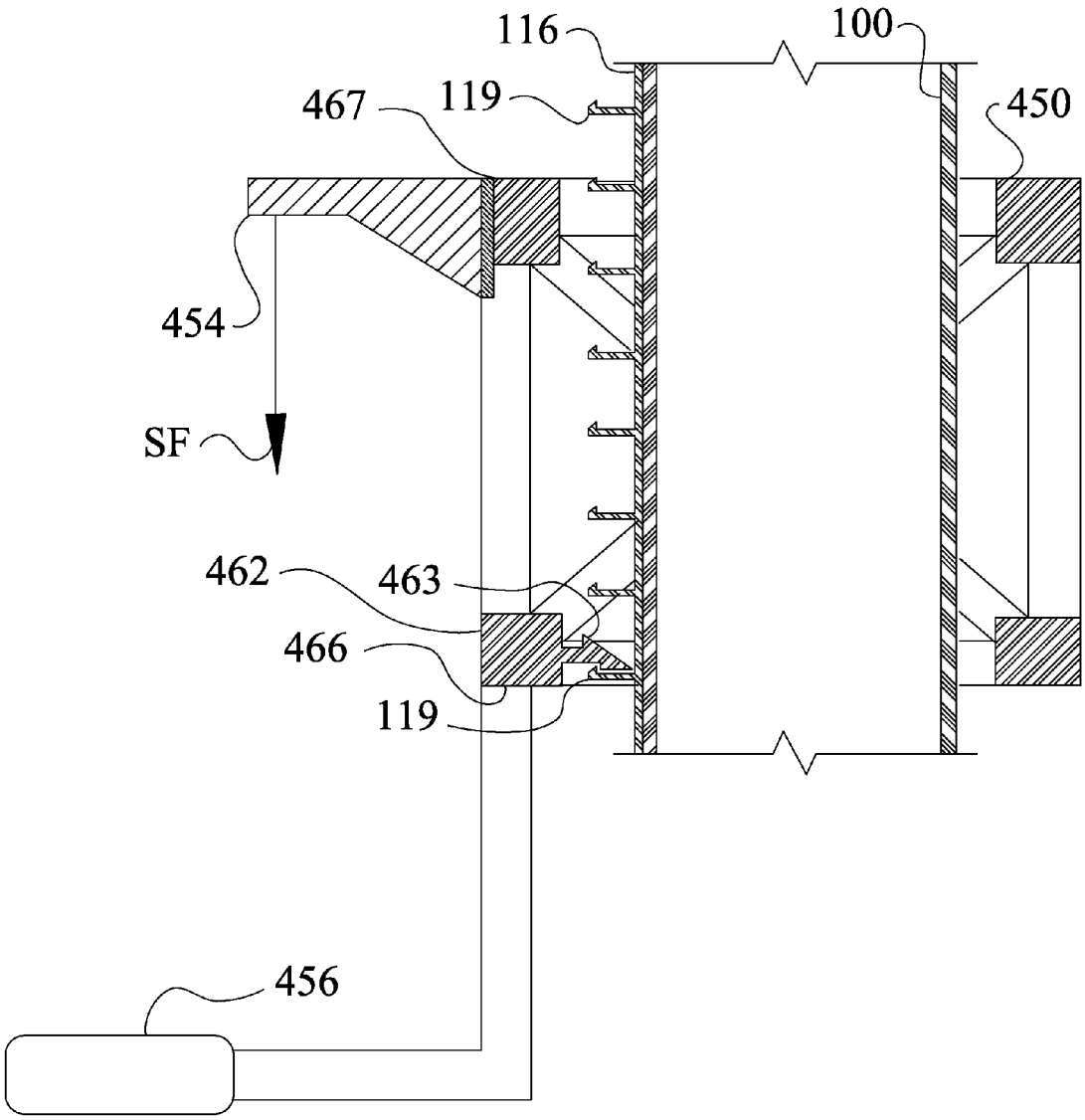
FIG. 27 is a schematic partial cross-section of several elements of the present invention, not to scale.
Figure 28:
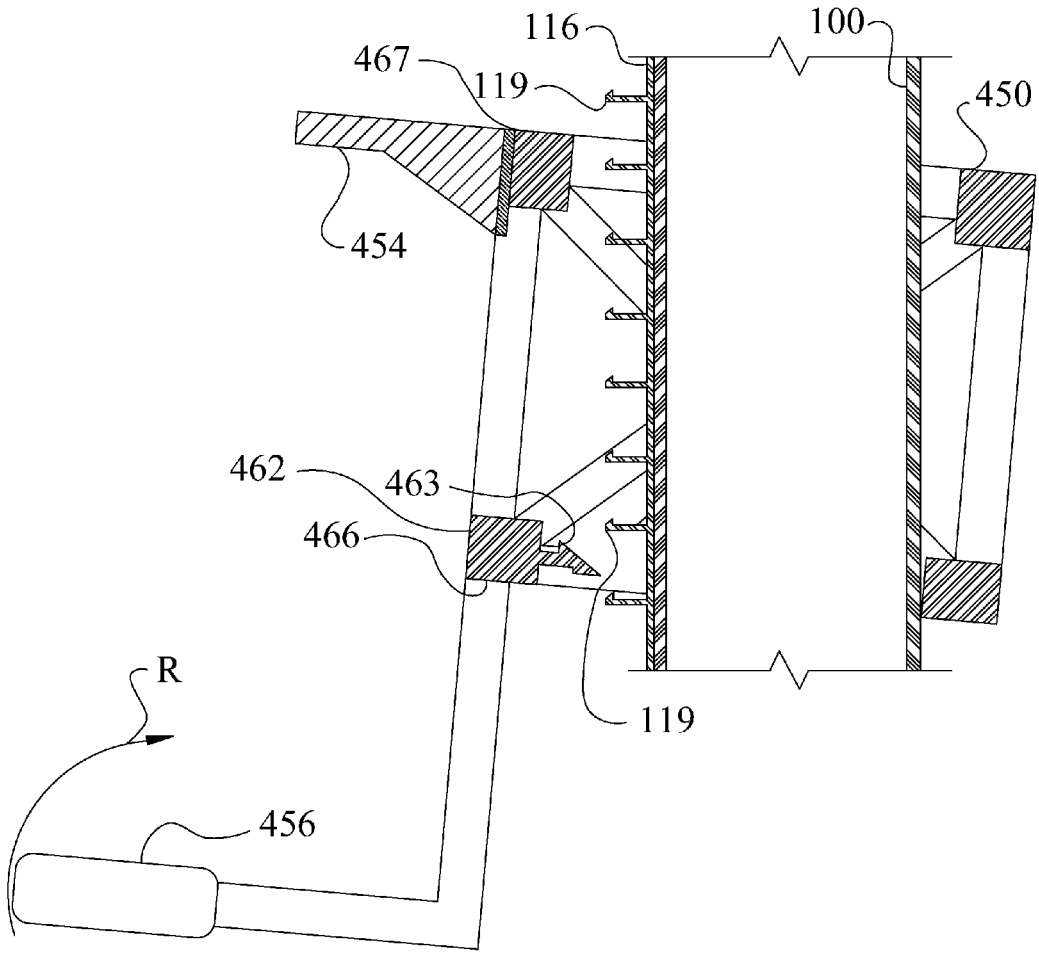
FIG. 28 is a schematic partial cross-section of several elements of the present invention, not to scale.

As previously mentioned, in some embodiments the plurality of safety engagement devices (117, 217) of the multifunction rails (116, 216) may be formed as locking projections (119, 219) extending from the multifunction rail (116, 216), as seen in FIGS. 18-21. In these embodiments, the plurality of sinistral safety engagement devices (117) are sinistral locking projections (119) extending from the sinistral multifunction rail (116), and the plurality of dextral safety engagement devices (217) are dextral locking projections (219) extending from the dextral multifunction rail (216). Similar to the embodiments previously described, most embodiments incorporating locking projections (119, 219) also incorporate carriage mast engagers (460, 480) in the form of a locking tongue that cooperates with the locking projections (119, 219). For example, in one embodiment the sinistral carriage mast engager (460) includes a sinistral carriage locking tongue (462) formed to cooperate with the sinistral locking projections (119) so that the sinistral carriage locking tongue (462) can engage with, and disengage from, any one of the sinistral locking projections (119) to releasably secure the sinistral carriage (450) to the sinistral multifunction rail (116), as seen in FIGS. 27 and 28, and the dextral carriage mast engager (480) includes a dextral carriage locking tongue (482) formed to cooperate with the dextral locking projections (219) so that the dextral carriage locking tongue (482) can engage with, and disengage from, any one of the dextral locking projections (219) to releasably secure the dextral carriage (470) to the dextral multifunction rail (216), not illustrated but similar to FIGS. 27 and 28. The actuation of the carriage locking tongues (462, 482) may be manually initiated by the force of the user or may be power actuated via hydraulics, pneumatics, or electromagnetics, just to name a few power sources. In one particular embodiment seen in FIGS. 10 and 11, the carriage operator handle (456, 476) includes a engager activation device (457, 477) that activates and deactivates the carriage mast engager (460, 480) to releasably lock the carriage (450, 470) to the modular mast (100, 200) thereby preventing unintentional descent of the carriage (450, 470).

In the embodiments incorporating locking projections (119, 219), the work platform (300) incorporates a sinistral platform mast engager (340) and a dextral platform mast engager (350), both of which are attached to the platform (300), configured to cooperate with at least one of the plurality of sinistral and dextral mast locking projections (119, 219) of the sinistral and dextral mast multifunction rails (116, 216). The platform mast engagers (340, 350) serve to releasably lock the platform (300) to the modular masts (100, 200) via the multifunction rails (116, 216) thereby preventing unintentional descent of the platform (300), as seen in one embodiment in FIGS. 25 and 26. Further, systematic locking of the platform (300) to the modular masts (100, 200) is required during the operation of the suspension platform system (10). The platform mast engagers (340, 350) may be virtually any device that can selectively lock the associated side of the work platform (302, 304) to the associated multifunction rail (116, 216). Most embodiments of the platform mast engagers (340, 350) include some form of a locking tongue. For instance, one embodiment includes a sinistral platform locking tongue (342) formed to cooperate with the sinistral locking projection (119) so that the sinistral platform locking tongue (342) can engage and disengage any one of the sinistral locking projections (119) to releasably secure the work platform sinistral end (302) to the sinistral multifunction rail (116). Similarly, in this embodiment, the dextral platform mast engager (350) includes a dextral platform locking tongue (352) formed to cooperate with the dextral locking projections (219) so that the dextral platform locking tongue (352) can engage and disengage any one of the dextral locking projections (219) to releasably secure the work platform dextral end (304) to the dextral multifunction rail (216).

In one particular embodiment illustrated in FIGS. 27 and 28 the sinistral carriage locking tongue (462) is a locking wedge (463) rigidly attached to the sinistral carriage (450) below the sinistral cable connector (454) and at, or above, the sinistral carriage proximal end (466). Similarly, in this embodiment the dextral carriage cable connector (474) is located substantially at the dextral carriage distal end (477) and the dextral carriage locking tongue (472) is a locking wedge (483) rigidly attached to the dextral carriage (470) below the dextral cable connector (474) and at, or above, the dextral carriage proximal end (476), not illustrated by similar to FIGS. 27 and 28. Therefore, to move the sinistral carriage (450) of this embodiment relative to the sinistral modular mast (100) the sinistral carriage locking wedge (463) and the sinistral carriage proximal end (466) must be moved away from the sinistral locking projections (119) so that the sinistral carriage locking wedge (463) may pass the sinistral locking projections (119) as the sinistral carriage (450) traverses the sinistral modular mast (100), as seen in FIG. 28. Such movement is generally accomplished by the user grabbing the operator handle (456) and rotating the carriage (450) as it is lifted, as indicated by the rotation arrow labeled R. Similarly, to move the dextral carriage (470) relative to the dextral modular mast (200) the dextral carriage locking wedge (483) and the dextral carriage proximal end (486) must be moved away from the dextral locking projections (219) so that the dextral carriage locking wedge (483) may pass the dextral locking projections (219) as the dextral carriage (470) traverses the dextral modular mast (200). Therefore, upon application of a suspension force (SF) on the sinistral carriage cable connector (454) the sinistral carriage locking wedge (463) engages at least one sinistral locking projection (119) thereby preventing movement of the sinistral carriage (450), as seen in FIG. 27. Similarly, upon application of a suspension force on the dextral carriage cable connector (474) the dextral carriage locking wedge (483) engages at least one dextral locking projection (219) thereby preventing movement of the dextral carriage (470). In this embodiment, application of a suspension load on the cable connectors (454, 474), along with their location, creates a moment that tends to force the fixed locking wedges (463, 483) into the safety engagement device (117, 217) ensuring a reliable engagement of the carriage (450, 470) and the modular mast (100, 200).

Figure 29:
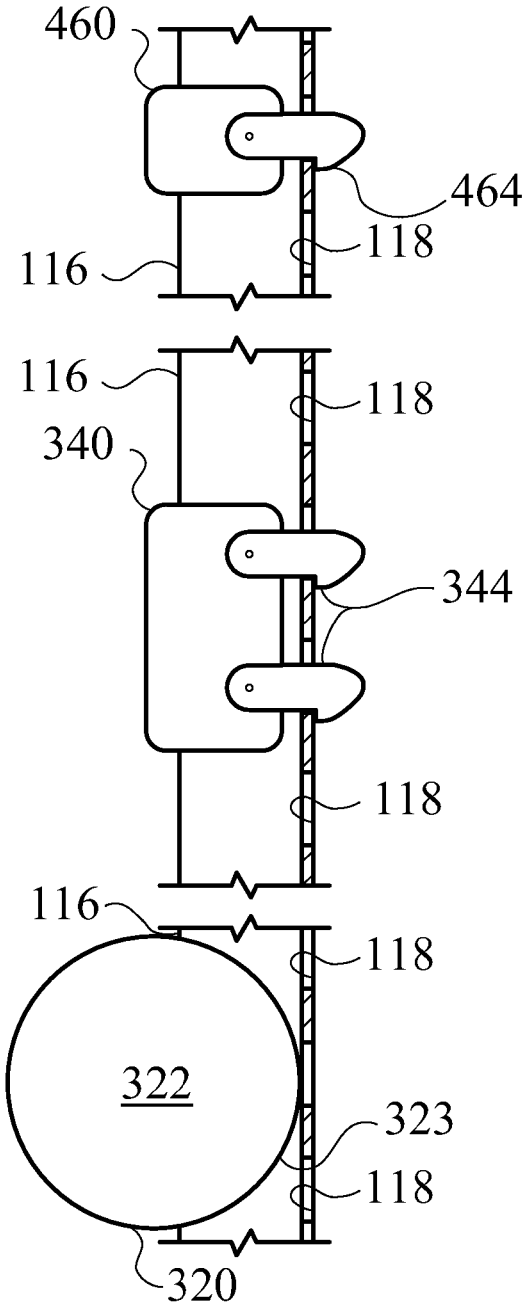
FIG. 29 is a schematic partial cross-section of several elements of the present invention, not to scale.
Figure 30:
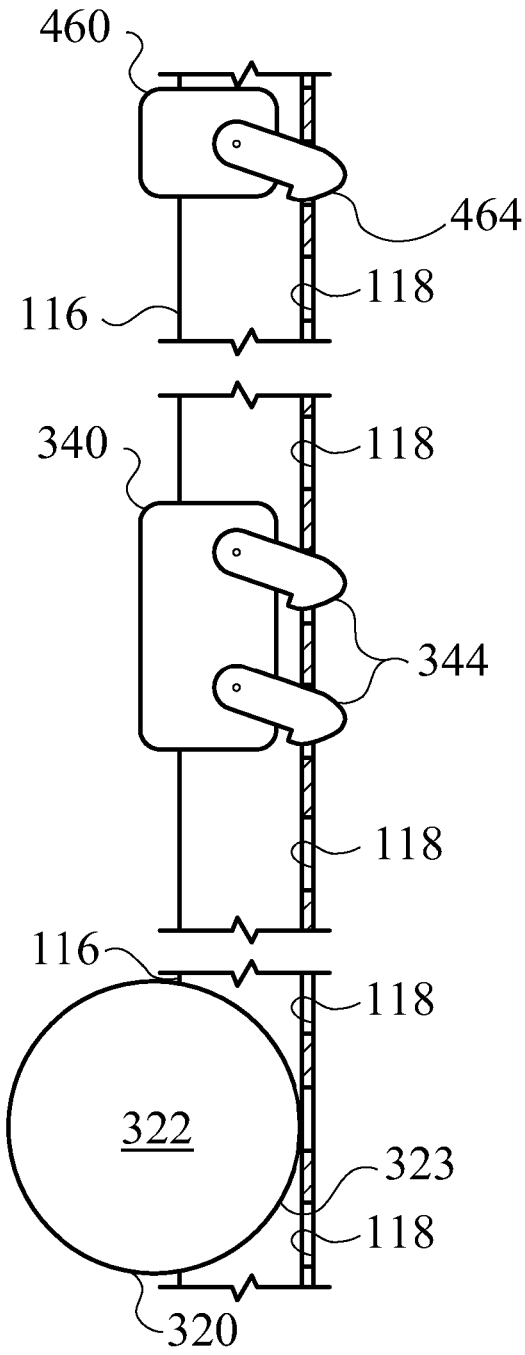
FIG. 30 is a schematic partial cross-section of several elements of the present invention, not to scale.

In an alternative embodiment the carriage locking tongues (462, 482) may be biased locking pawls (464, 484) attached to the carriages (450, 470), as seen in FIGS. 29 and 30. To increase the elevation of the carriages (450, 470) relative to the modular mast (100, 200) the carriage (450, 470) is forced upward and the carriage biased locking pawl (464, 484) pivots as it contacts the locking projections (119, 219), or the locking recesses (118, 218), so that the carriage (450, 470) may pass the locking projections (119, 219) as the carriage (450, 470) traverses the modular mast (100, 200). The biased locking pawl (464, 484) snaps back into an engaged position, due to the biased nature of the pawl, as soon as it passes the locking projections (119, 219), or locking recesses (118, 218). Further, upon application of a suspension force on the carriage cable connector (454, 474) the carriage biased locking pawl (464, 484) engages at least one locking projection (119, 219), or locking recesses (118, 218) thereby preventing movement of the carriage (450, 470). While FIGS. 29 and 30 only illustrate the sinistral elements with respect locking recesses (118), one with skill in the art will appreciate that the biased locking pawl (464) applies equally as well to a dextral biased locking pawl (484), as well as biased locking pawls (464, 484) for use with locking projections (119, 219).

Figure 5:
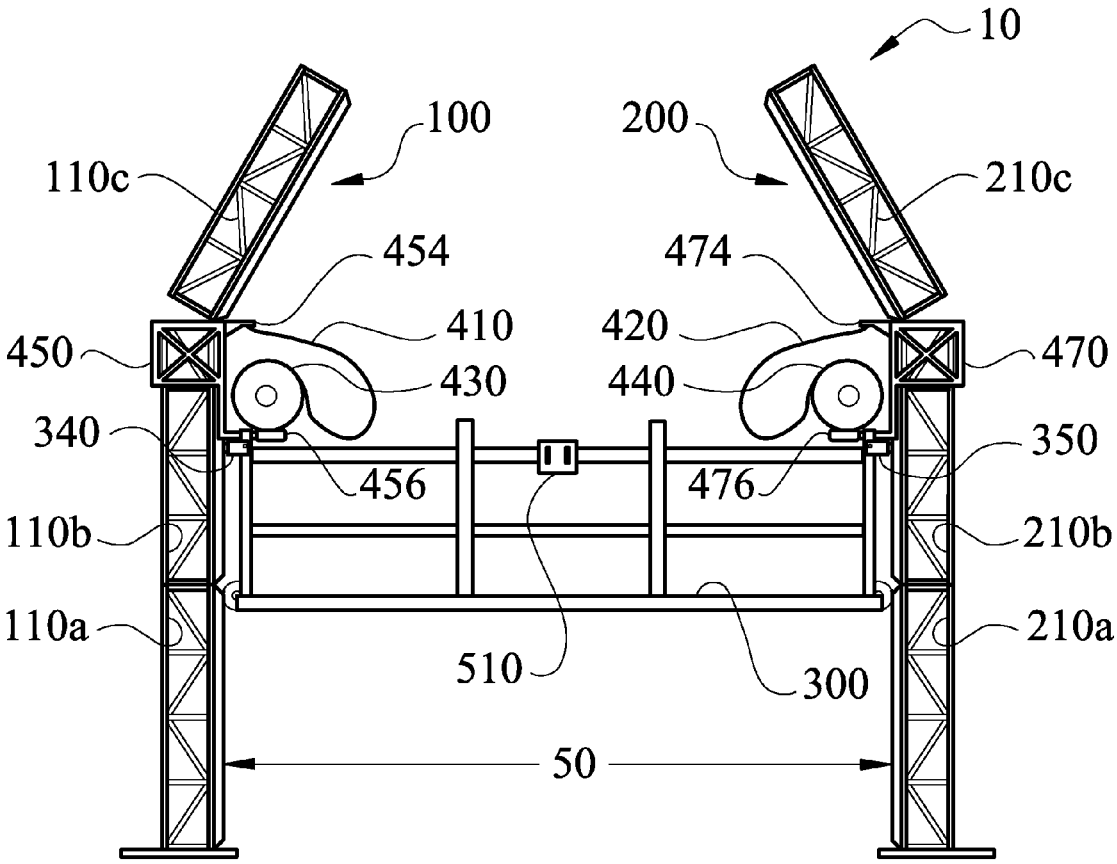
FIG. 5 is a schematic side elevation view of the self-erecting suspension platform, not to scale.
Figure 6:
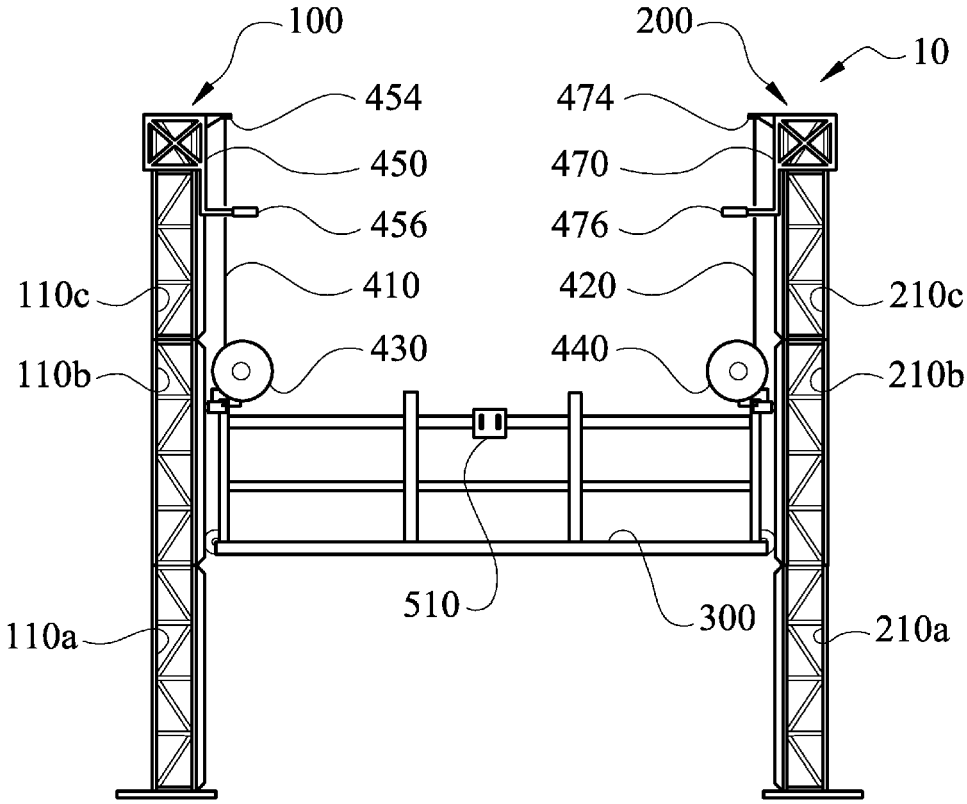
FIG. 6 is a schematic side elevation view of the self-erecting suspension platform, not to scale.
Figure 16:
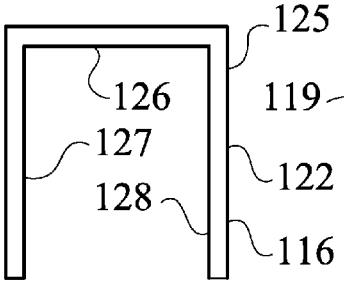
FIG. 16 is a schematic top plan view of an embodiment of the multifunction rail, not to scale.
Figure 18:
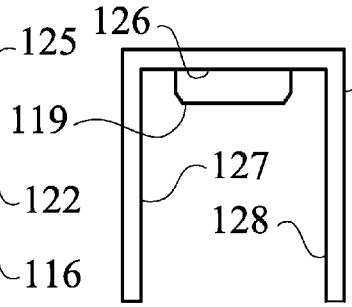
FIG. 18 is a schematic top plan view of an embodiment of the multifunction rail, not to scale.
Figure 32:
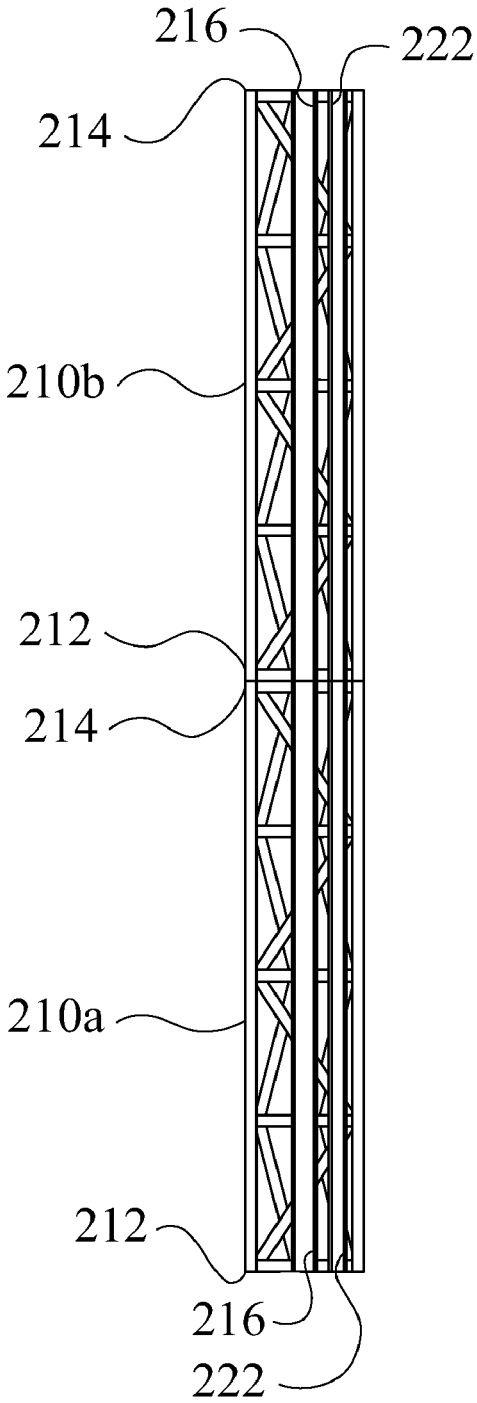
FIG. 32 is a schematic front elevation view of a portion of the dextral modular mast, not to scale.

As previously mentioned, the work platform (300) also has a sinistral mast stabilizer (320) and a dextral mast stabilizer (330) attached to the platform (300), illustrated in FIG. 5, and configured to cooperate with the sinistral and dextral mast stabilizer guide device (122, 222), seen in FIGS. 31 and 32, of the sinistral and dextral mast multifunction rails (116, 216) to prevent undesired swaying of the suspended work platform (300). In one particular embodiment seen explicitly in FIGS. 16 and 17 and generally in most of the figures, the sinistral stabilizer guide device (122) is integral to the sinistral multifunction rail (116) and the dextral stabilizer guide device (222) is integral to the dextral multifunction rail (216). In a further embodiment seen in FIGS. 25 and 26, the work platform sinistral mast stabilizer (320) includes at least one sinistral platform roller (322) in rolling contact with the sinistral stabilizer guide device (122) to prevent swaying of the suspended work platform (300) and the work platform dextral mast stabilizer (330) includes at least one dextral platform roller (332) in rolling contact with the dextral stabilizer guide device (222) to prevent swaying of the suspended work platform (300).

In a further embodiment, the sinistral and dextral multifunction rails (116, 216) are U-shaped multifunction rails (125, 225), illustrated in FIGS. 16-19 with respect to the sinistral elements, having a bearing surface (126, 226), a first sidewall (127, 227), and a second sidewall (128, 228). In this configuration the mast stabilizers (320, 330) are retained between the first sidewall (127, 227) and the second sidewall (128, 228), as seen in FIG. 22. Alternatively, the sinistral and dextral multifunction rails (116, 216) may be V-shaped multifunction rails (130, 230) having a first bearing surface (131, 231) substantially orthogonal to a second bearing surface (132, 232), as seen in FIG. 23. In this embodiment the mast stabilizers (320, 330) are retained between the first bearing surface (131, 232) and the second bearing surface (132, 232). This embodiment is particularly unique in that the multifunction rails (116, 216) may incorporate locking projections (119, 219) extending from the rails (116, 216) that do not interfere with the movement and wear of the mast stabilizers (320, 330).

Figure 15:
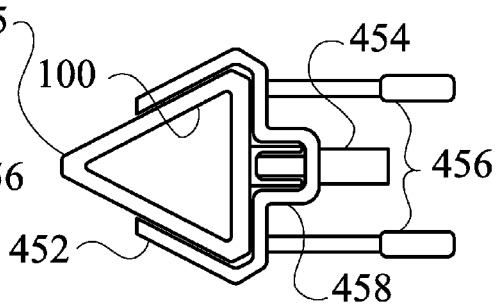
FIG. 15 is a schematic top plan view of an embodiment of the sinistral carriage, not to scale.

The carriages (450, 470) may be constructed in a number of arrangements. The carriage bodies (452, 472) may completely encircle the modular mast perimeters (145, 245), as seen in FIG. 14, or the carriage bodies (452, 472) may only partially enclose the modular masts (100, 200), as seen in FIG. 15. Moreover, the carriages (450, 470) may be configured to cooperate with the modular masts (100, 200) such that the carriage bodies (452, 472) are external to the modular mast perimeters (145, 245). Further, the carriages (450, 470) may include a guide (458, 478) configured to cooperate with the associated multifunction rail (116, 216) and constrain the movement of the carriage (450, 470) on the modular mast (100, 200), as seen in FIGS. 12 and 13. As seen in FIGS. 10 and 11, the operator handle (456, 476) of the carriage (450, 470) generally extends beyond the distal end (467, 487) of the carriage (450, 470) so that the user can easily maneuver the carriage (450, 470) to an elevation beyond the normal reach of the user. Additionally, the construction of the carriages (450, 470) generally varies with the type of safety engagement devices (117, 217). For example, in the previously disclosed embodiments wherein the carriage (450, 470) incorporates a rigidly attached locking wedge (463, 483) the carriage (450, 470) must fit relatively loosely around the modular masts (100, 200) so that the carriage locking wedges (463, 483) may be moved by manipulation of the carriage (450, 470) to pass the locking projections (119, 219), as seen in FIGS. 27 and 28. Alternatively, embodiments having safety engagement devices (117, 217) that simply extend and retract, as in the embodiments of FIGS. 25 and 26, or rotate such as the biased locking pawls (344, 444) of FIGS. 29 and 30, to lock the carriages (450, 470) to the modular masts (100, 200) may have much tighter fits between the carriages (450, 470) and the modular masts (100, 200).

In one particular embodiment, the system (10) contains enough cable (410, 420) such that the work platform (300) may be lowered from the highest elevation to the ground without having to reposition the carriages (450, 470). Such is particularly beneficial when the user needs to return the work platform (300) to ground level to obtain more supplies or take a break.

Figure 35:
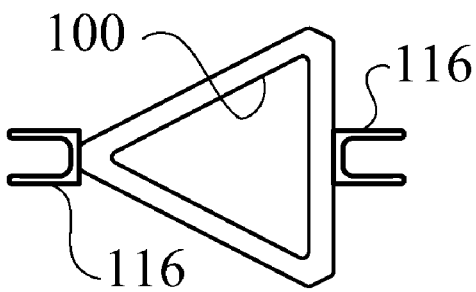
FIG. 35 is a schematic top plan view of an embodiment of the sinistral modular mast and multifunction rails, not to scale.
Figure 36:
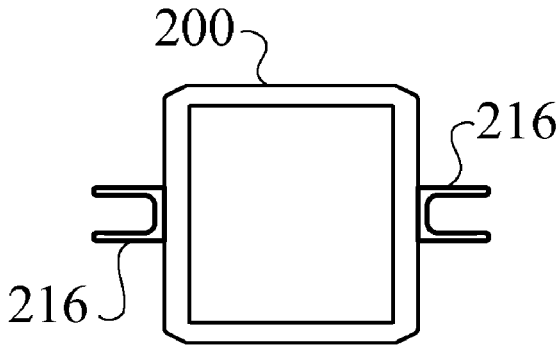
FIG. 36 is a schematic top plan view of an embodiment of the dextral modular mast and multifunction rails, not to scale.

As one with skill in the art will appreciate, each modular mast (100, 200) may have more than one multifunction rail (116, 216), as seen in FIGS. 35 and 36. This is particularly beneficial when multiple work platforms (300) are used next to one another. For instance, two work platforms (300) may be installed adjacent to one another thereby sharing a modular mast (100, 200) such that only three modular masts are needed for the operation of two work platforms (300). This concept extends to job sites utilizing ten or more work platforms (300) to facilitate work on an entire face of a structure.

Referring now generally to FIGS. 37-44*b*, particular embodiments of the sinistral and dextral modular mast units (110*a*, 110*b*, 210*a*, 210*b*) are shown. In these embodiments, the sinistral and dextral modular mast units (110*a*, 110*b*, 210*a*, 210*b*) are substantially identical to one another. However, in some embodiments, the second sinistral and dextral mast units (110*b*, 210*b*) differ slightly from the first sinistral and dextral mast units (110*a*, 210*a*). For example, in one embodiment, the first sinistral and dextral mast units (110*a*, 210*a*) have a longer mast length than the second sinistral and dextral mast units (110*b*, 210*b*) and all subsequent mast units. In a particular example, the first sinistral and dextral mast units (110*a*, 210*a*) each have a length of about 8 feet, while the second sinistral and dextral mast units (110*b*, 210*b*), and all subsequent mast units, have a length of about 45 inches. Moreover, and as discussed in more detail below, the second sinistral and dextral mast units (110*b*, 210*b*), and all subsequent mast units, may include a sinistral and dextral unit interconnection device (135, 235). As previously described, the second sinistral mast unit (110*b*) is configured to stack vertically upon and releasably attach to the first sinistral mast unit (110*a*), which is configured for releasable attachment to the sinistral base plate (113). Likewise, the second dextral mast unit (210*b*) is configured to stack vertically upon and releasably attach to the first dextral mast unit (210*a*), which is configured for releasable attachment to the dextral base plate (213).

Figure 37:
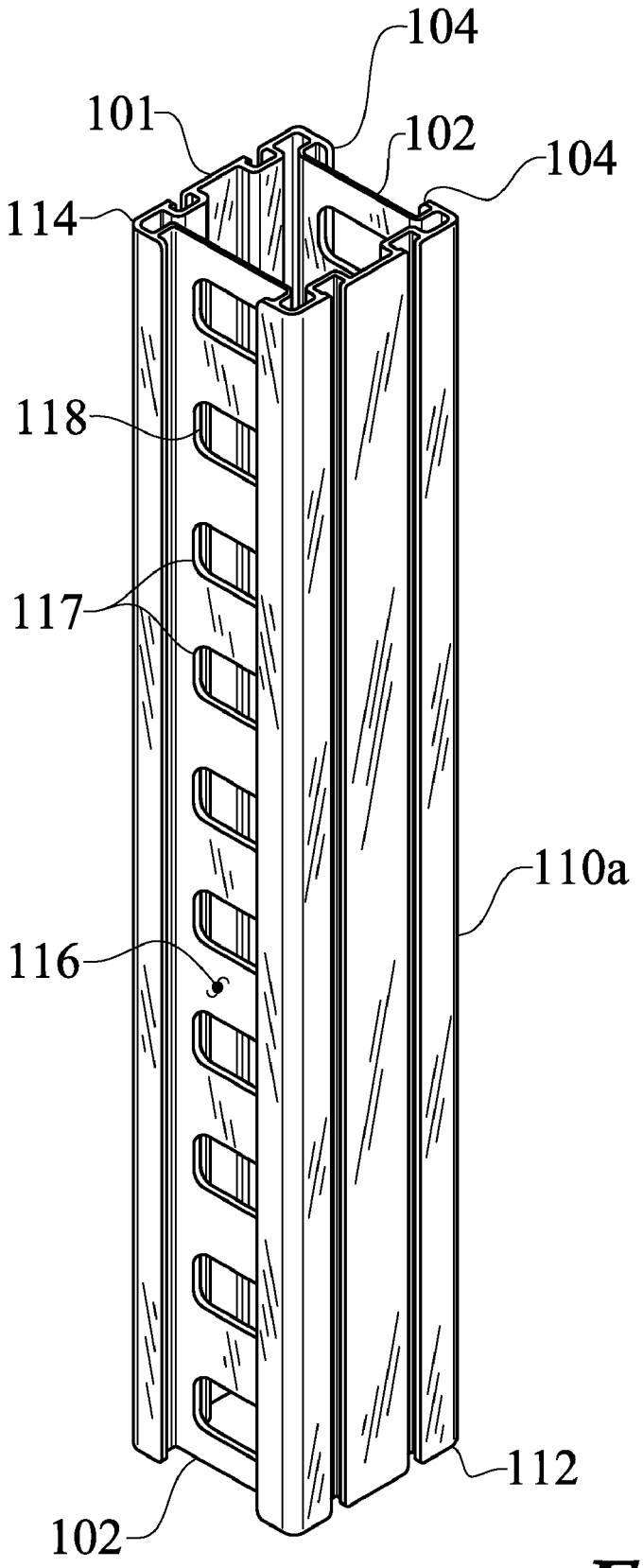
FIG. 37 is a perspective view of an embodiment of the first sinistral modular mast unit, not to scale.
Figure 38:
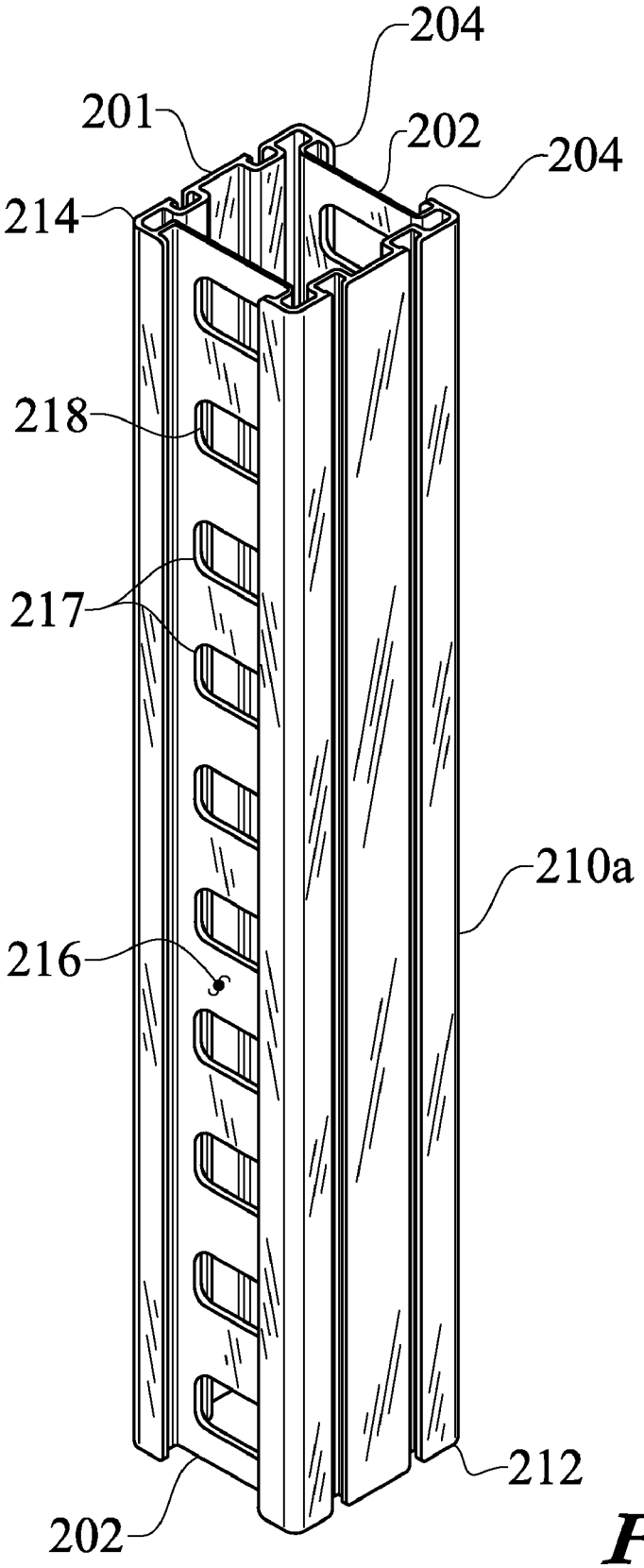
FIG. 38 is a perspective view of an embodiment of the first dextral modular mast unit, not to scale.
Figure 39:
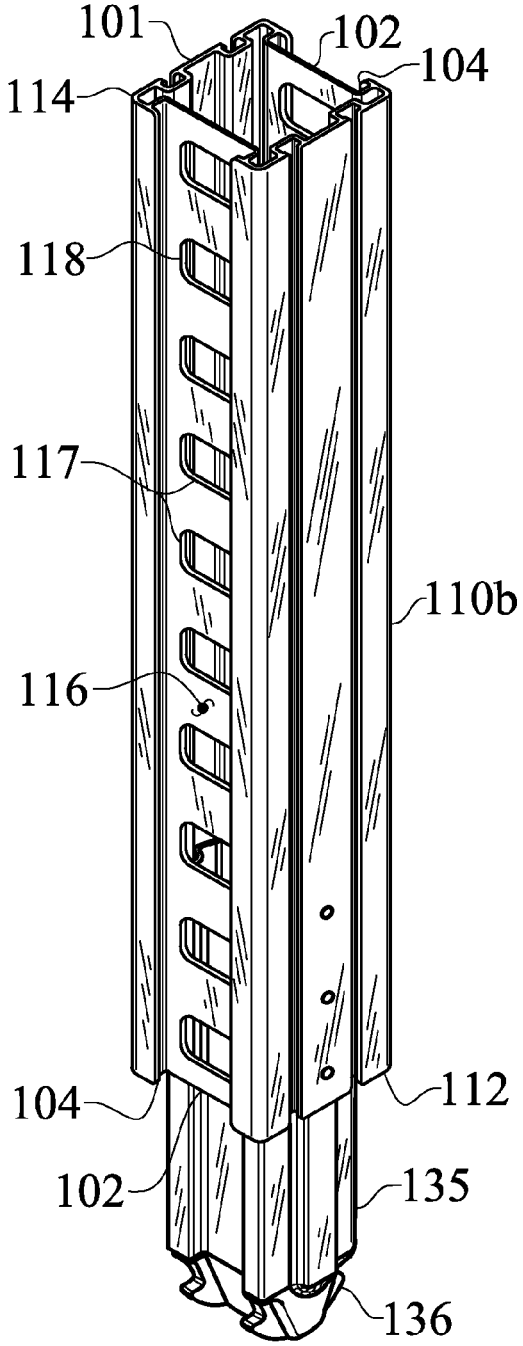
FIG. 39 is a perspective view of an embodiment of the second sinistral modular mast unit, not to scale.

Still referring to FIGS. 37-44*b*, the mast units (110*a*, 110*b*, 210*a*, 210*b*) will now be described with respect to the sinistral elements only. One with skill in the art will appreciate that the following description applies equally well for comparable elements associated with the dextral mast units (210*a*, 210*b*). As seen in FIGS. 37, 39 and 43, each sinistral mast unit (110*a*, 110*b*) has a mast unit perimeter (101) including at least one recessed perimeter portion (102) that is partially bounded by at least two guide-lock extensions (104). The at least two guide-lock extensions (104) are separated by a locking neck width (105), as seen in FIGS. 43 and 43*a*. The sinistral mast units (110*a*, 110*b*) further include a mast width (103), seen in FIG. 43*a*, a distal end (112), and a proximal end (114). Further, each sinistral mast unit (110*a*, 110*b*) includes a multifunction rail (116) that is partially defined by the at least one recessed perimeter portion (102) and extends from the distal end (112) to the proximal end (114), as seen in FIG. 37. The multifunction rail (116) has a multifunction rail width (116*a*), seen in FIG. 43*a*, a plurality of safety engagement devices (117), and a stabilizer guide device (122). As previously described, the plurality of safety engagement devices (117) of the multifunction rail (116) may be formed as locking recesses (118) formed in the multifunction rail (116). The locking recesses (118) formed in the multifunction rail (116) are generally openings that extend completely through the multifunction rail (116), although they may simply be recesses formed in the multifunction rail (116).

Again with reference to the sinistral elements only, in one particular embodiment, as best shown in FIGS. 43-43*b*, the sinistral mast units (110*a*, 110*b*) include a mast unit perimeter (101) having six recessed perimeter portions (102) that are each partially bounded by at least two guide-lock extensions (104). As one with skill in the art will appreciate, the sinistral mast units (110*a*, 110*b*) may have more or less than six recessed perimeter portions (102) depending on the particular application and use. For example, in the embodiments shown having six recessed perimeter portions (102), the two larger recessed perimeter portions (102) may partially define two multifunction rails (116) on each mast unit (110*a*, 110*b*), which is particularly beneficial when two work platforms (300) are used adjacent to one another so that one modular mast (100) may be shared such that only three modular masts are needed to operate two work platforms (300). However, it should be noted that only one multifunction rail (116) is necessary for each sinistral mast unit (110*a*, 110*b*) to function.

In another embodiment, the sinistral mast units (110*a*, 110*b*) may include at least one anchoring rail (115) that is partially defined by at least one recessed perimeter portion (102). Thus, in this particular embodiment, the mast unit perimeter (101) would include at least two recessed perimeter portions (102), with one recessed perimeter portion (102) partially defining the multifunction rail (116) and one recessed perimeter portion (102) partially defining the at least one anchoring rail (115). The at least one anchoring rail (115) is configured for cooperative engagement with an anchoring device (120) that may be anchored to a structure, not shown, to brace the mast units (110*a*, 110*b*) to increase the safety of the platform system (10). Typically, the anchoring device (120) is temporarily fixedly secured to the structure while a task is being performed. Thus, as best seen in FIG. 43*b*, the four smaller recessed perimeter portions (102) partially define four anchoring rails (115) that may be utilized to receive and lock in an anchoring device (120) to brace the mast units (110*a*, 110*b*) to increase the safety and stability of the platform system (10). Typically, the at least one anchoring rail (115) is on a portion of the mast unit perimeter (101) that is adjacent the multifunction rail (116).

In yet another embodiment and with reference to FIG. 43*a*, the sinistral mast units (110*a*, 110*b*) are constructed with unique dimensional relationships. For example, in one embodiment, the sinistral mast units (110*a*, 110*b*) have a multifunction rail width (116*a*) that is at least fifty percent of the sinistral mast width (103). This particular relationship is not simply to maximize or minimize the size of the sinistral mast units (110*a*, 110*b*); rather, it recognizes a delicate balance for ensuring structural integrity and safety. With a multifunction rail width (116*a*) of at least fifty percent of the sinistral mast width (103), the work platform (300) load is distributed more evenly over the mast units (110*a*, 110*b*) and the work platform (300) is less prone to undesired swaying. In still another embodiment, the sinistral locking neck width (105) adjacent the sinistral multifunction rail (116) is at least eighty percent of the sinistral multifunction rail width (116*a*). This particular embodiment also serves to distribute the work platform (300) load over the mast units (110*a*, 110*b*) and further minimizes the opportunity for undesired swaying of the work platform (300) by ensuring that the at least two lock-guide extensions (104) provide bearing support for the work platform (300) sinistral mast stabilizer (320).

Figure 40:
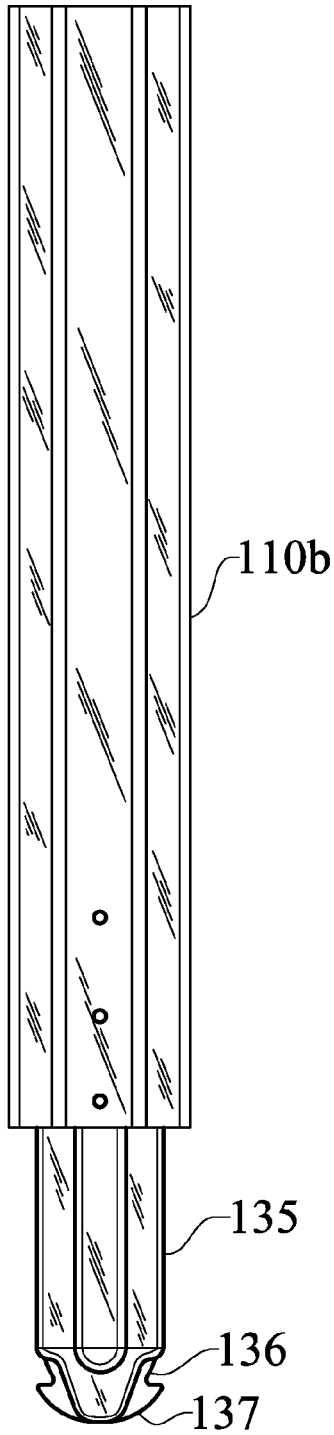
FIG. 40 is a side elevation view of an embodiment of the second sinistral modular mast unit, not to scale.
Figure 41:
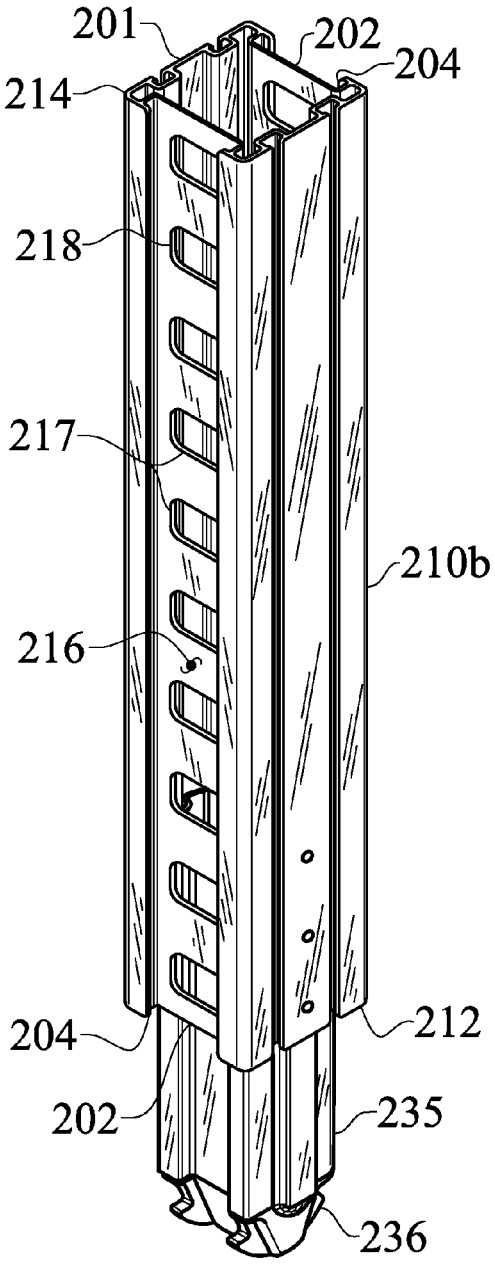
FIG. 41 is a perspective view of an embodiment of the second dextral modular mast unit, not to scale.
Figure 42:
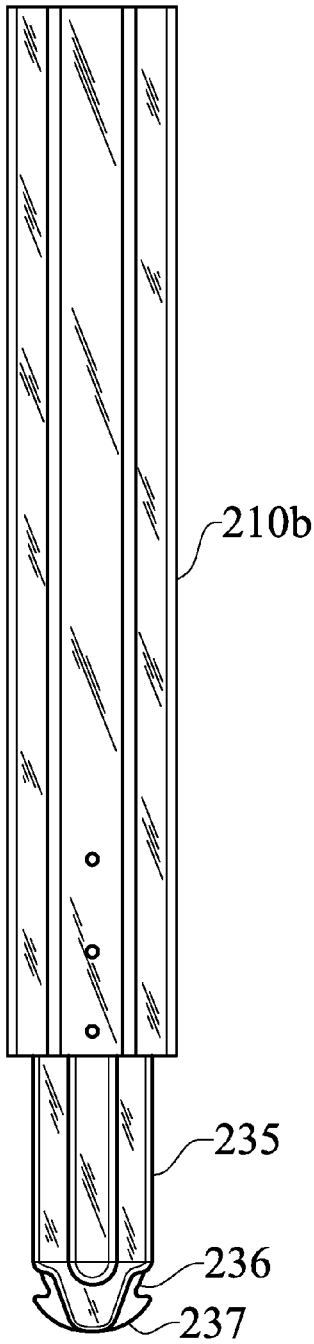
FIG. 42 is a side elevation view of an embodiment of the second dextral modular mast unit, not to scale.

As previously mentioned, and again with reference to the sinistral elements only, the first sinistral mast unit (110*a*) is configured for releasable attachment to the sinistral base plate (113) that is in contact with the ground for stability and to help distribute the load of the sinistral modular mast (100). In erecting the sinistral modular mast (100), the second sinistral mast unit (110*b*) is joined to the first sinistral mast unit (110*a*). To this end, the second sinistral mast unit (110*b*), and all subsequent mast units, may include a sinistral unit interconnection device (135) joined to the distal end (112) of the second sinistral mast unit (110*b*), as seen in FIGS. 39 and 40. The sinistral unit interconnection device (135) is configured for engagement with the proximal end (114) of the first sinistral mast unit (110*a*) such that the sinistral unit interconnection device (135) joins the second sinistral mast unit (110*b*) to the first sinistral mast unit (110*a*). When the second sinistral mast unit (110*b*) is joined to the first sinistral mast unit (110*a*), the sinistral multifunction rails (116) of each sinistral mast unit (110*a*, 110*b*) substantially align. Additionally, in embodiments having at least one sinistral anchoring rail (115), the at least one sinistral anchoring rail of each sinistral mast unit (110*a*, 110*b*) substantially align.

As previously mentioned, the sinistral mast unit perimeter (101) may include at least two sinistral recessed perimeter portions (102) that are each partially bounded by at least two sinistral guide-lock extensions (104). In one embodiment, the sinistral unit interconnection device (135) of the second sinistral mast unit (110*b*) may be configured to cooperate with at least one of the at least two sinistral recessed perimeter portions (102) of the adjacent first sinistral mast unit (110*a*). By configuring the sinistral unit interconnection device (135) to cooperate with at least one of the sinistral recessed perimeter portions (102) of the first sinistral mast unit (110*a*), the amount of surface contact between the sinistral unit interconnection device (135) and the first sinistral mast unit (110*a*) is increased. The increase in the amount of surface contact promotes the structural integrity of the joined first and second sinistral mast units (110*a*, 110*b*), and increases safety. In a particular embodiment, the cooperation between the sinistral unit interconnection device (135) and at least one of the at least two sinistral recessed perimeter portions (102) of the adjacent first sinistral mast unit (110*a*) increases the amount of surface contact between the sinistral unit interconnection device (135) and the first sinistral mast unit (110*a*) by at least forty percent.

In yet another particular embodiment, the unit interconnection device (135) of the second sinistral mast unit (110*b*), and all subsequent mast units, may further include a unit assembly positioner (136) having a curved contact surface (137), as best seen in FIG. 40. When erecting the sinistral modular mast (100), the distal end (112) of the second sinistral mast unit (110*b*) is typically placed in roughly horizontal contact with the proximal end (114) of the first sinistral mast unit (110*a*). Next, the second sinistral mast unit (110*b*) is rotated vertically until it vertically aligns with the first sinistral mast unit (110*a*). In embodiments featuring a unit assembly positioner (136) having a curved contact surface (137), when the unit assembly positioner (136) is placed in contact with the proximal end (114) of the first sinistral mast unit (110*a*), the curved contact surface (137) assists in the rotation of the second sinistral mast unit (110*b*) to a vertical position such that the second sinistral mast unit (110*b*) aligns with the first sinistral mast unit (110*a*) to facilitate the joining of the sinistral mast units (110*a*, 110*b*).

As best seen in FIG. 43, the sinistral mast units (110*a*, 110*b*) may have a generally square shaped mast unit perimeter (101) and a tube-like construction. However, one with skill in the art will recognize that other shapes and configurations may be utilized, including but not limited to, triangular, rectangular, and trapezoidal, just to name a few. The sinistral mast units (110*a*, 110*b*) may be manufactured by an extrusion process. Preferably, the sinistral mast units (110*a*, 110*b*) are formed of aluminum, an aluminum based alloy, or other metals that are light to facilitate easy lifting, yet exhibit strong mechanical properties. However, this particular embodiment of the mast units (110*a*, 110*b*) also facilitates the use of heavier materials due to the reduced amount of material required for producing mast units (110*a*, 110*b*) having a tube-like construction. Moreover, constructing the sinistral mast units (110*a*, 110*b*) with a recessed multifunction rail (116) facilitates orderly placement and stacking of the mast units (110*a*, 110*b*) on pallets, platforms, or other surfaces by removing parts of the mast units (110*a*, 110*b*) that extend beyond the general mast unit perimeter (101).

Referring now to FIG. 45, the interaction between a portion of the work platform (300) and an embodiment of a sinistral modular mast (100) is shown. Although FIG. 45 only shows the interaction between a portion of the work platform (300) and an embodiment of the sinistral modular mast (100), the same interaction is equally applicable between the work platform (300) and an embodiment of the dextral modular mast (200). As previously described, the work platform (300) has a sinistral mast stabilizer (320) attached to the platform (300) and configured to cooperate with the sinistral mast stabilizer guide device (122) of the sinistral multifunction rail (116) to prevent undesired swaying of the suspended work platform (300). Also, the work platform (300) has a sinistral platform mast engager (340) attached to the platform (300) and configured to cooperate with at least one of the plurality of sinistral mast safety engagement devices (117) of the sinistral mast multifunction rail (116) to releasably lock the work platform (300) to the sinistal modular mast (100) to prevent unintentional descent of the work platform (300).

With reference now to FIGS. 43 and 45, in one particular embodiment, the sinistral mast stabilizer guide device (122) is integral to the sinistral mast multifunction rail (116) and is formed by the at least two guide-lock extensions (104). As seen in FIGS. 43 and 45, the sinistral mast stabilizer guide device (122) provides two projecting rails that lock the sinistral mast stabilizer (320) onto the sinistral modular mast (100) and guide the sinistral mast stabilizer (320) as the work platform (300) moves up and down the sinistral modular mast (100). As seen in FIG. 45, the sinistral mast stabilizer (320) may include at least one sinistral platform roller (322) in rolling contact with the sinistral mast stabilizer guide device (122) to prevent swaying of the suspended work platform (300). However, the sinistral mast stabilizer (320) may be configured as a plate, or any other shape, that may be constrained and guided along the sinistral modular mast (100) by the sinistral mast stabilizer guide device (122). Again, although FIG. 45 only shows the interaction between a portion of the work platform (300) and an embodiment of the sinistral modular mast (100), the same interactions are equally applicable between the dextral elements of the work platform (300) and an embodiment of the dextral modular mast (200).

Referring now to FIGS. 46 and 47, a particular embodiment of the sinistral carriage (450) is shown. Although FIGS. 46 and 47 show an embodiment of the carriage (450) labeled with respect to the sinistral elements, one with skill in the art will appreciate that the following description and disclosure is equally applicable to an embodiment of the dextral carriage (470). As seen in FIG. 47, the sinistral carriage (450) is adapted for cooperative engagement with the sinistral mast multifunction rail (116) so that the sinistral carriage (450) may be conveniently slid up and down the sinistral modular mast (100) by a user. As with previous embodiments, the sinistral carriage (450) has a proximal end (466), a distal end (467), a body (452), a cable connector (454), and a carriage mast engager (460), which is configured to releasably lock the sinistral carriage (450) to the sinistral modular mast (100) to prevent unintentional descent of the sinistral carriage (450).

Still referring to FIGS. 46 and 47, the sinistral carriage (450) includes a sinistral guide (458) configured to cooperate with the sinistral multifunction rail (116) and constrain movement of the sinistral carriage (450). In this embodiment, the sinistral carriage (450) is pivotably connected to the sinistral guide (458) along a pivot axis (P) so that the sinistral carriage (450) pivots from a translation position to a locking position. In the translation position, the sinistral carriage mast engager (460) does not engage the sinistral modular mast (100), thus allowing the sinistral carriage (450) and sinistral guide (458) to translate vertically along the sinistral modular mast (100). When pivoted to the locking position, as seen in FIG. 47, the sinistral carriage mast engager (460) releasably locks the sinistral carriage (450) to the sinistral mast multifunction rail (116) via any one of the plurality of sinistral safety engagement devices (117) to thereby prevent vertical translation of the sinistral carriage (450) and sinistral guide (458) along the sinistral modular mast (100).

Now, having described a number of embodiments, the general sequence of operation may be disclosed. Operation of the system (10) begins with the positioning of the first mast units (110*a*, 210*a*) and the work platform (300), as seen in FIG. 3. Next, second mast units (110*b*, 210*b*) are lifted so that at least one portion of the second mast unit (110*b*, 210*b*) may be positioned on top of a portion of the first mast unit (110*a*, 210*a*). This positioning allows the user to rotate the second mast unit (110*b*, 210*b*) into place. When the second mast units (110*b*, 210*b*) are rotated to the vertical position, the second mast units (110*b*, 210*b*) are releasably joined to the first mast units (110*a*, 210*a*). The mast units (110*a*, 110*b*, 210*a*, 210*b*) may also be releasably secured together with traditional fastening devices such as bolts. The first pair of second mast units (110*b*, 210*b*) are generally installed with the carriages (450, 470) already in place, as seen in FIG. 3.

Now, with the mast units (110*a*, 110*b*, 210*a*, 210*b*) in the vertical position, the hoisting system cables (410, 420) are attached to the cable connectors (454, 474) and the hoists (430, 440). The hoists (430, 440) are then activated at the central control console (510) to lift the work platform (300) to the position shown in FIG. 5. Once the work platform (300) has been lifted approximately the length of one mast unit (110*a*, 110*b*, 210*a*, 210*b*), the platform mast engagers (330, 340) are activated to secure the work platform (300) to the masts (100, 200). Next, the user may install a third set of modular mast units (110*c*, 210*c*). Subsequently, the user advances the carriages (450, 470) to the proximal end (114, 214) of the third set of modular mast units (110*c*, 210*c*), at which point the carriages (450, 470) are locked to the masts (100, 200). To further advance the work platform (300), the user may repeat the steps of: (a) engaging the hoists (430, 440) to lift the work platform (300) to the elevation of the carriages (450, 470); (b) locking the work platform (300) to the masts (100, 200) via the platform mast engagers (340, 350); (c) installing an additional set of modular masts; and (d) releasing the carriages (450, 470) from the masts (100, 200) so that they may be advanced and locked to the newly installed set of modular mast units. An alternative embodiment includes secondary safety cables that may be attached from the work platform (300) to the masts (100, 200) as the carriages (450, 470) are moved so that the security of the work platform (300) is not solely dependent on the platform mast engagers (340, 350) as the carriages (450, 470) are moved.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Moreover, although some embodiments have been described with respect to sinistral elements, one with skill in the art will appreciate that the description and disclosure applies equally well to dextral elements. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A self-erecting suspension platform system (10), comprising:

(i) a sinistral modular mast (100) having at least a first sinistral mast unit (110*a*) and a second sinistral mast unit (110*b*), wherein the first sinistral mast unit (110*a*) and the second sinistral mast unit (110*b*) are separate stackable units with each having:

(a) a sinistral mast unit perimeter (101), the sinistral mast unit perimeter (101) including at least one sinistral recessed perimeter portion (102), wherein the at least one sinistral recessed perimeter portion (102) is partially bounded by at least two sinistral guide-lock extensions (104) and the at least two sinistral guide-lock extensions (104) are separated by a sinistral locking neck width (105);

(b) a sinistral mast width (103), a sinistral distal end (112), and a sinistral proximal end (114); and (c) a sinistral multifunction rail (116) partially defined by the at least one sinistral recessed perimeter portion (102) and extending from the sinistral distal end (112) to the sinistral proximal end (114), the sinistral multifunction rail (116) including a sinistral multifunction rail width (116*a*), a plurality of sinistral safety engagement devices (117), and a sinistral stabilizer guide device (122);

(ii) a dextral modular mast (200), separated from the sinistral modular mast (100) by a mast separation distance (50), having at least a first dextral mast unit (210*a*) and a second dextral mast unit (210*b*), wherein the first dextral mast unit (210*a*) and the second dextral mast unit (210*b*) are separate stackable units with each having:

(a) a dextral mast unit perimeter (201), the dextral mast unit perimeter (201) including at least one dextral recessed perimeter portion (202), wherein the at least one dextral recessed perimeter portion (202) is partially bounded by at least two dextral guide-lock extensions (204) and the at least two dextral guide-lock extensions (204) are separated by a dextral locking neck width (205);

(b) a dextral mast width (203), a dextral distal end (212), and a dextral proximal end (214); and (c) a dextral multifunction rail (216) partially defined by the at least one dextral recessed perimeter portion (202) and extending from the dextral distal end (212) to the dextral proximal end (214), the dextral multifunction rail (216) including a dextral multifunction rail width (216*a*), a plurality of dextral safety engagement devices (217), and a dextral stabilizer guide device (222);

(iii) a work platform (300) having a work platform sinistral end (302) and a work platform dextral end (304), a railing (310), a sinistral mast stabilizer (320) attached to the work platform (300) and configured to cooperate with the sinistral mast stabilizer guide device (122) of the sinistral mast multifunction rail (116) to prevent undesired swaying of the suspended work platform (300), a dextral mast stabilizer (330) attached to the work platform (300) and configured to cooperate with the dextral mast stabilizer guide device (222) of the dextral mast multifunction rail (216) to prevent undesired swaying of the suspended work platform (300), a sinistral platform mast engager (340) attached to the work platform (300) and configured to cooperate with at least one of the plurality of sinistral safety engagement devices (117) of the sinistral mast multifunction rail (116) to releasably lock the work platform (300) to the sinistral modular mast (100) thereby preventing unintentional descent of the work platform (300), a dextral platform mast engager (350) attached to the work platform (300) and configured to cooperate with at least one of the plurality of dextral safety engagement devices (217) of the dextral mast multifunction rail (216) to releasably lock the work platform (300) to the dextral modular mast (200) thereby preventing unintentional descent of the work platform (300), wherein the work platform (300) is located between the sinistral modular mast (100) and the dextral modular mast (200) such that the work platform sinistral end (302) is adjacent to the sinistral modular mast (100) and the work platform dextral end (304) is adjacent to the dextral modular mast (200);

(iv) a hoisting system (400) configured to suspend the work platform (300) from the sinistral modular mast (100) and the dextral modular mast (200), including:

(a) a sinistral carriage (450) adapted for cooperative engagement with the sinistral mast multifunction rail (116) so that the sinistral carriage (450) may be conveniently slid up and down the sinistral modular mast (100) by a user, having a sinistral carriage proximal end (466), a sinistral carriage distal end (467), a sinistral carriage body (452), a sinistral cable connector (454), and a sinistral carriage mast engager (460) to releasably lock the sinistral carriage (450) to the sinistral mast multifunction rail (116) thereby preventing unintentional descent of the sinistral carriage (450);

(b) a dextral carriage (470) adapted for cooperative engagement with the dextral mast multifunction rail (216) so that the dextral carriage (470) may be conveniently slid up and down the dextral modular mast (200) by a user, having a dextral carriage proximal end (486), a dextral carriage distal end (487), a dextral carriage body (472), a dextral cable connector (474), and a dextral carriage mast engager (480) to releasably lock the dextral carriage (470) to the dextral multifunction rail (216) thereby preventing unintentional descent of the dextral carriage (470);

(c) a sinistral mast hoist (430) attached to the work platform (300) near the work platform sinistral end (302);

(d) a dextral mast hoist (440) attached to the work platform (300) near the work platform dextral end (304);

(e) a sinistral mast cable (410) attached to the sinistral cable connector (454) and the sinistral mast hoist (430) thereby suspending the work platform (300) from the sinistral carriage (450); and (f) a dextral mast cable (420) attached to the dextral cable connector (474) and the dextral mast hoist (440) thereby suspending the work platform (300) from the dextral carriage (470); and (v) at least one control system (500) in communication with the sinistral mast hoist (430) and the dextral mast hoist (440), wherein the at least one control system (500) operates the sinistral mast hoist (430) and the dextral mast hoist (440) to control the elevation of the work platform (300), wherein the sinistral carriage (450) includes a sinistral guide (458) configured to cooperate with the sinistral multifunction rail (116) and constrain the movement of the sinistral carriage (450) on the sinistral modular mast (100); and wherein the dextral carriage (470) includes a dextral guide (478) configured to cooperate with the dextral multifunction rail (216) and constrain the movement of the dextral carriage (470) on the dextral modular mast (200); wherein the sinistral carriage (450) is pivotably connected to the sinistral guide (458) so that the sinistral carriage (450) may pivot from a translation position that allows vertical translation of the sinistral carriage (450) and sinistral guide (458) to a locking position that prevents vertical translation of the sinistral carriage (450) and sinistral guide (458); and wherein the dextral carriage (470) is pivotably connected to the dextral guide (478) so that the dextral carriage (470) may pivot from a translation position that allows vertical translation of the dextral carriage (470) and dextral guide (478) to a locking position that prevents vertical translation of the dextral carriage (470) and dextral guide (478).

2. The platform system (10) of claim 1, wherein the second sinistral mast unit (110*b*) includes a sinistral unit interconnection device (135) joined to the sinistral distal end (112) of the second sinistral mast unit (110*b*) and configured for engagement with the sinistral proximal end (114) of the adjacent first sinistral mast unit (110*a*) such that the sinistral unit interconnection device (135) joins the second sinistral mast unit (110*b*) to the first sinistral mast unit (110*a*); and wherein the second dextral mast unit (210*b*) includes a dextral unit interconnection device (235) joined to the dextral distal end (212) of the second dextral mast unit (210*b*) and configured for engagement with the dextral proximal end (214) of the adjacent first dextral mast unit (210*a*) such that the dextral unit interconnection device (235) joins the second dextral mast unit (210*b*) to the first dextral mast unit (210*a*).

3. The platform system (10) of claim 1, wherein the plurality of sinistral safety engagement devices (117) are sinistral locking recesses (118) formed in the sinistral multifunction rail (116), and the plurality of dextral safety engagement devices (217) are dextral locking recesses (218) formed in the dextral multifunction rail (216).

4. The platform system (10) of claim 3, wherein the sinistral carriage mast engager (460) includes a sinistral carriage locking tongue (462) formed to cooperate with the sinistral locking recesses (118) so that the sinistral carriage locking tongue (462) can engage any one of the sinistral locking recesses (118) to releasably secure the sinistral carriage (450) to the sinistral multifunction rail (116), and the dextral carriage mast engager (480) includes a dextral carriage locking tongue (482) formed to cooperate with the dextral locking recesses (218) so that the dextral carriage locking tongue (482) can engage any one of the dextral locking recesses (218) to releasably secure the dextral carriage (470) to the dextral multifunction rail (216).

5. The platform system (10) of claim 3, wherein the sinistral platform mast engager (340) includes a sinistral platform locking tongue (342) formed to cooperate with the sinistral locking recesses (118) so that the sinistral platform locking tongue (342) can engage any one of the sinistral locking recesses (118) to releasably secure the work platform sinistral end (302) to the sinistral multifunction rail (116), and the dextral platform mast engager (350) includes a dextral platform locking tongue (352) formed to cooperate with the dextral locking recesses (218) so that the dextral platform locking tongue (352) can engage any one of the dextral locking recesses (218) to releasably secure the work platform dextral end (304) to the dextral multifunction rail (216).

6. The platform system (10) of claim 1, wherein the sinistral mast unit perimeter (101) further includes at least two sinistral recessed perimeter portions (102) and each of the at least two sinistral recessed perimeter portions (102) is partially bounded by at least two sinistral guide-lock extensions (104), and wherein the first sinistral mast unit (110*a*) and the second sinistral mast unit (110*b*) each include at least one sinistral anchoring rail (115) partially defined by at least one of the at least two sinistral recessed perimeter portions (102), wherein the at least one sinistral anchoring rail (115) of the first sinistral mast unit (110*a*) and the second sinistral mast unit (110*b*) substantially align and are configured for cooperative engagement with a sinistral anchoring device (120) to brace the first sinistral mast unit (110*a*) and the second sinistral mast unit (110*b*); and wherein the dextral mast unit perimeter (201) further includes at least two dextral recessed perimeter portions (202) and each of the at least two dextral recessed perimeter portions (202) is partially bounded by at least two dextral guide-lock extensions (204), and wherein the first dextral mast unit (210*a*) and the second dextral mast unit (210*b*) each include at least one dextral anchoring rail (215) partially defined by at least one of the at least two dextral recessed perimeter portions (202), wherein the at least one dextral anchoring rail (215) of the first dextral mast unit (210*a*) and the second dextral mast unit (210*b*) substantially align and are configured for cooperative engagement with a dextral anchoring device (220) to brace the first dextral mast unit (210*a*) and the second dextral mast unit (210*b*).

7. The platform system (10) of claim 1, wherein the sinistral stabilizer guide device (122) is integral to the sinistral multifunction rail (116) and the dextral stabilizer guide device (222) is integral to the dextral multifunction rail (216).

8. The platform system (10) of claim 7, wherein the work platform sinistral mast stabilizer (320) includes at least one sinistral platform roller (322) in rolling contact with the sinistral stabilizer guide device (122) to prevent swaying of the suspended work platform (300); and wherein the work platform dextral mast stabilizer (330) includes at least one dextral platform roller (332) in rolling contact with the dextral stabilizer guide device (222) to prevent swaying of the suspended work platform (300).

9. The platform system (10) of claim 2, wherein the sinistral unit interconnection device (135) of the second sinistral mast unit (110*b*) further includes a sinistral unit assembly positioner (136) having a sinistral curved contact surface (137) such that when the sinistral unit assembly positioner (136) is placed in contact with the sinistral proximal end (114) of the first sinistral mast unit (110*a*) the sinistral curved contact surface (137) permits rotation of the second sinistral mast unit (110*b*) to a vertical position such that the second sinistral mast unit (110*b*) aligns with the first sinistral mast unit (110*a*); and wherein the dextral unit interconnection device (235) of the second dextral mast unit (210*b*) further includes a dextral unit assembly positioner (236) having a dextral curved contact surface (237) such that when the dextral unit assembly positioner (236) is placed in contact with the dextral proximal end (214) of the first dextral mast unit (210*a*) the dextral curved contact surface (237) permits rotation of the second dextral mast unit (210*b*) to a vertical position such that the second dextral mast unit (210*b*) aligns with the first dextral mast unit (210*a*).

10. The platform system (10) of claim 1, wherein the sinistral multifunction rail width (116*a*) is at least fifty percent of the sinistral mast width (103); and wherein the dextral multifunction rail width (216*a*) is at least fifty percent of the dextral mast width (203).

11. The platform system (10) of claim 1, wherein the sinistral locking neck width (105) adjacent the sinistral multifunction rail (116) is at least eighty percent of the sinistral multifunction rail width (116*a*); and wherein the dextral locking neck width (205) adjacent the dextral multifunction rail (216) is at least eighty percent of the dextral multifunction rail width (216*a*).

12. The platform system (10) of claim 2, wherein the sinistral mast unit perimeter (101) further includes at least two sinistral recessed perimeter portions (102) and each of the at least two sinistral recessed perimeter portions (102) is partially bounded by at least two sinistral guide-lock extensions (104), and wherein the sinistral unit interconnection device (135) of the second sinistral mast unit (110*b*) is configured to cooperate with at least one of the at least two sinistral recessed perimeter portions (102) of the adjacent first sinistral mast unit (110*a*) to increase the amount of surface contact between the sinistral unit interconnection device (135) and the first sinistral mast unit (110*a*); and wherein the dextral mast unit perimeter (201) further includes at least two dextral recessed perimeter portions (202) and each of the at least two dextral recessed perimeter portions (202) is partially bounded by at least two dextral guide-lock extensions (204), and wherein the dextral unit interconnection device (235) of the second dextral mast unit (210*b*) is configured to cooperate with at least one of the at least two dextral recessed perimeter portions (202) of the adjacent first dextral mast unit (210*a*) to increase the amount of surface contact between the dextral unit interconnection device (235) and the first dextral mast unit (210*a*).

13. A self-erecting suspension platform system (10), comprising:

(i) a sinistral modular mast (100) having at least a first sinistral mast unit (110*a*) and a second sinistral mast unit (110*b*), wherein the first sinistral mast unit (110*a*) and the second sinistral mast unit (110*b*) are separate stackable units with each having:

(a) a sinistral mast unit perimeter (101), the sinistral mast unit perimeter (101) including at least one sinistral recessed perimeter portion (102), wherein the at least one sinistral recessed perimeter portion (102) is partially bounded by at least two sinistral guide-lock extensions (104) and the at least two sinistral guide-lock extensions (104) are separated by a sinistral locking neck width (105);

(b) a sinistral mast width (103), a sinistral distal end (112), and a sinistral proximal end (114); and (c) a sinistral multifunction rail (116) partially defined by the at least one sinistral recessed perimeter portion (102) and extending from the sinistral distal end (112) to the sinistral proximal end (114), the sinistral multifunction rail (116) including a sinistral multifunction rail width (116*a*), a plurality of sinistral safety engagement devices (117), and a sinistral stabilizer guide device (122);

(ii) a dextral modular mast (200), separated from the sinistral modular mast (100) by a mast separation distance (50), having at least a first dextral mast unit (210*a*) and a second dextral mast unit (210*b*), wherein the first dextral mast unit (210*a*) and the second dextral mast unit (210*b*) are separate stackable units with each having:

(a) a dextral mast unit perimeter (201), the dextral mast unit perimeter (201) including at least one dextral recessed perimeter portion (202), wherein the at least one dextral recessed perimeter portion (202) is partially bounded by at least two dextral guide-lock extensions (204) and the at least two dextral guide-lock extensions (204) are separated by a dextral locking neck width (205);

(b) a dextral mast width (203), a dextral distal end (212), and a dextral proximal end (214); and (c) a dextral multifunction rail (216) partially defined by the at least one dextral recessed perimeter portion (202) and extending from the dextral distal end (212) to the dextral proximal end (214), the dextral multifunction rail (216) including a dextral multifunction rail width (216*a*), a plurality of dextral safety engagement devices (217), and a dextral stabilizer guide device (222);

(iii) a work platform (300) having a work platform sinistral end (302) and a work platform dextral end (304), a railing (310), a sinistral mast stabilizer (320) attached to the work platform (300) and configured to cooperate with the sinistral mast stabilizer guide device (122) of the sinistral mast multifunction rail (116) to prevent undesired swaying of the suspended work platform (300), a dextral mast stabilizer (330) attached to the work platform (300) and configured to cooperate with the dextral mast stabilizer guide device (222) of the dextral mast multifunction rail (216) to prevent undesired swaying of the suspended work platform (300), a sinistral platform mast engager (340) attached to the work platform (300) and configured to cooperate with at least one of the plurality of sinistral safety engagement devices (117) of the sinistral mast multifunction rail (116) to releasably lock the work platform (300) to the sinistral modular mast (100) thereby preventing unintentional descent of the work platform (300), a dextral platform mast engager (350) attached to the work platform (300) and configured to cooperate with at least one of the plurality of dextral safety engagement devices (217) of the dextral mast multifunction rail (216) to releasably lock the work platform (300) to the dextral modular mast (200) thereby preventing unintentional descent of the work platform (300), wherein the work platform (300) is located between the sinistral modular mast (100) and the dextral modular mast (200) such that the work platform sinistral end (302) is adjacent to the sinistral modular mast (100) and the work platform dextral end (304) is adjacent to the dextral modular mast (200);

(iv) a hoisting system (400) configured to suspend the work platform (300) from the sinistral modular mast (100) and the dextral modular mast (200), including:

(a) a sinistral carriage (450) adapted for cooperative engagement with the sinistral mast multifunction rail (116) so that the sinistral carriage (450) may be conveniently slid up and down the sinistral modular mast (100) by a user, having a sinistral carriage proximal end (466), a sinistral carriage distal end (467), a sinistral carriage body (452), a sinistral cable connector (454), and a sinistral carriage mast engager (460) to releasably lock the sinistral carriage (450) to the sinistral mast multifunction rail (116) thereby preventing unintentional descent of the sinistral carriage (450);

(b) a dextral carriage (470) adapted for cooperative engagement with the dextral mast multifunction rail (216) so that the dextral carriage (470) may be conveniently slid up and down the dextral modular mast (200) by a user, having a dextral carriage proximal end (486), a dextral carriage distal end (487), a dextral carriage body (472), a dextral cable connector (474), and a dextral carriage mast engager (480) to releasably lock the dextral carriage (470) to the dextral multifunction rail (216) thereby preventing unintentional descent of the dextral carriage (470);

(c) a sinistral mast hoist (430) attached to the work platform (300) near the work platform sinistral end (302);

(d) a dextral mast hoist (440) attached to the work platform (300) near the work platform dextral end (304);

(e) a sinistral mast cable (410) attached to the sinistral cable connector (454) and the sinistral mast hoist (430) thereby suspending the work platform (300) from the sinistral carriage (450); and (f) a dextral mast cable (420) attached to the dextral cable connector (474) and the dextral mast hoist (440) thereby suspending the work platform (300) from the dextral carriage (470); and (v) a control system (500) having a central control station (510) in communication with the sinistral mast hoist (430) and the dextral mast hoist (440) to control the elevation of the work platform (300) by operating the sinistral mast hoist (430) and the dextral mast hoist (440), wherein the sinistral carriage (450) includes a sinistral guide (458) configured to cooperate with the sinistral multifunction rail (116) and constrain the movement of the sinistral carriage (450) on the sinistral modular mast (100); and wherein the dextral carriage (470) includes a dextral guide (478) configured to cooperate with the dextral multifunction rail (216) and constrain the movement of the dextral carriage (470) on the dextral modular mast (200); wherein the sinistral carriage (450) is pivotably connected to the sinistral guide (458) so that the sinistral carriage (450) may pivot from a translation position that allows vertical translation of the sinistral carriage (450) and sinistral guide (458) to a locking position that prevents vertical translation of the sinistral carriage (450) and sinistral guide (458); and wherein the dextral carriage (470) is pivotably connected to the dextral guide (478) so that the dextral carriage (470) may pivot from a translation position that allows vertical translation of the dextral carriage (470) and dextral guide (478) to a locking position that prevents vertical translation of the dextral carriage (470) and dextral guide (478).

* * * * *